US006143973A

United States Patent [19]

Kikuchi

[11] Patent Number: 6,143,973

[45] Date of Patent: Nov. 7, 2000

[54] PROCESS TECHNIQUES FOR PLURALITY KIND OF MUSICAL TONE INFORMATION

[75] Inventor: Takeshi Kikuchi, Hamamatsu, Japan

[73] Assignee: Yamaha Corporation, Hamamatsu, Japan

[21] Appl. No.: 09/174,642

[22] Filed: Oct. 19, 1998

[30] Foreign Application Priority Data

Oct. 22, 1997 [JP] Japan ..... 9-290093
Mar. 10, 1998 [JP] Japan ..... 10-058438

[51] Int. Cl.[7] ..... G10H 7/00

[52] U.S. Cl. ..... 84/645; 84/600

[58] Field of Search ..... 84/600, 645

[56] References Cited

U.S. PATENT DOCUMENTS 5,569,869 10/1996 Sone .
5,734,119 3/1998 France .
5,737,531 4/1998 Ehley .
5,883,957 3/1999 Moline et al. .
5,928,330 7/1999 Goetz et al. .

FOREIGN PATENT DOCUMENTS 4-18835 1/1992 Japan .
4-40133 2/1992 Japan .
7-64579 3/1995 Japan .

*Primary Examiner*—Jeffrey Donels
*Attorney, Agent, or Firm*—Morrison & Foerster

[57] ABSTRACT

A communications apparatus for musical tone information having: an adding unit for adding time information on a common time axis to each of first and second musical tone information; a transmitting unit for transmitting each of the first and second musical tone information added with the time information associated with each of the first and second musical tone information; a receiving unit for receiving the first and second musical tone information and the time information associated with each of the first and second musical tone information, transmitted by the transmitting unit; and an output unit for synchronizing the first and second musical tone information in accordance with the time information and outputting the synchronized first and second musical tone information to a reproduction apparatus.

35 Claims, 25 Drawing Sheets

PROCESS TECHNIQUES FOR PLURALITY KIND OF MUSICAL TONE INFORMATION

BACKGROUND OF THE INVENTION a) Field of the Invention

The present invention relates to techniques for processing musical tone information, and more particularly to techniques for processing musical tone information of two kinds or more and reproducing it.

b) Description of the Related Art

As a standard specification for communications between electronic musical instruments, a musical instrument digital interface (MIDI) specification is known. Electronic musical instruments equipped with interfaces of the MIDI specification can communicate with each other by transferring MIDI data via a MIDI cable. For example, an electronic musical instrument transmits MIDI data of a musical performance made by a player, and another musical instrument receives it to reproduce it. As one electronic musical instrument is played, another electronic musical instrument can be played in real time.

In a communications network interconnecting a plurality of general computers, various types of data are transferred. For example, live musical tone data or other MIDI data can be transmitted from one computer, which once stored the data in its storage device such as a hard disk, via the communications network to another computer which stores the received data in its storage device. A general communications network is, however, configured to perform only general data communications, and is not configured to properly process MIDI data.

Specifically, although the MIDI specification allows the real time communications to be performed between electronic musical instruments, it is not suitable for long distance communications and communications via a number of nodes. The general communications network is essentially configured to provide services of long distance communications and multiple-node communications, but it does not take account of real time communications between electronic musical instruments.

Musical tone information includes MIDI data and audio data. The MIDI data conforms with the MIDI specification and includes a key-on event (e.g., key depression information), a key-off event (e.g., key release information). The audio data is data generated by a microphone for example. The microphone converts voices (including musical tones produced by musical equipments) into analog electric audio signals. The analog audio signals are converted into digital audio signals to obtain audio data. The audio data is stored, for example, in a compact disk, a digital audio tape, or the like.

A communications apparatus includes a transmitter and a receiver. The transmitter is desired to be able to transmit a mixture of MIDI data and audio data. The receiver is desired to be able to receive and reproduce both the MIDI data and audio data at the same time. It is possible to transfer only one of the MIDI data and audio data, but it is difficult to transfer a mixture of MIDI data and audio data.

Even if a mixture of MIDI data and audio data can be transferred, it is difficult to reproduce both the data synchronously. Although it is possible to start reproducing both the data at the same time, there is no means for synchronizing both the data after the start of reproduction.

SUMMARY OF THE INVENTION

It is an object of the present invention to provide a communications system and method capable of synchronously reproducing a plurality kind of musical tone information, and a computer readable medium storing a program for realizing such a method.

It is another object of the present invention to provide a control system and method capable of properly controlling musical tone information including MIDI data and audio data, and a computer readable medium storing a program for realizing such a method.

According to one aspect of the present invention, there is provided a communications apparatus for musical tone information comprising: means for adding time information on a common time axis to each of first and second musical tone information; and transmitting means for transmitting each of the first and second musical tone information added with the time information associated with each of the first and second musical tone information.

According to another aspect of the present invention, there is provided a communications apparatus for musical tone information comprising: receiving means for receiving first and second musical tone information and time information associated with each of the first and second musical tone information; and output means for synchronizing the first and second musical tone information in accordance with the time information and outputting the synchronized first and second musical tone information to a reproduction apparatus.

The transmitting means transmits each of the first and second musical tone information added with the time information associated with each of the first and second musical tone information, and the receiving means receives the first and second musical tone information and the time information. The output means outputs the first and second musical tone information synchronized in accordance with the time information, so that the timing shift between the first and second musical tone information can be corrected to thereafter reproduce the musical tone information.

According to another aspect of the present invention, there is provided a musical tone information control apparatus, comprising: means for designating a musical tone parameter; control means for controlling MIDI data and audio data in accordance with the musical tone parameter designated by the designating means; and reproduction designating means for designating a reproduction of the MIDI data and audio data controlled by the control means.

In accordance with the designated musical tone parameter, MIDI data and audio data are controlled and a reproduction is designated. Both the MIDI data and audio data can be controlled properly and easily.

BRIEF DESCRIPTION OF THE DRAWINGS

FIG. 17 is a diagram showing an input screen displaying a volume operator, a balance operator and the like.

DETAILED DESCRIPTION OF THE PREFERRED EMBODIMENTS

Figure 1:
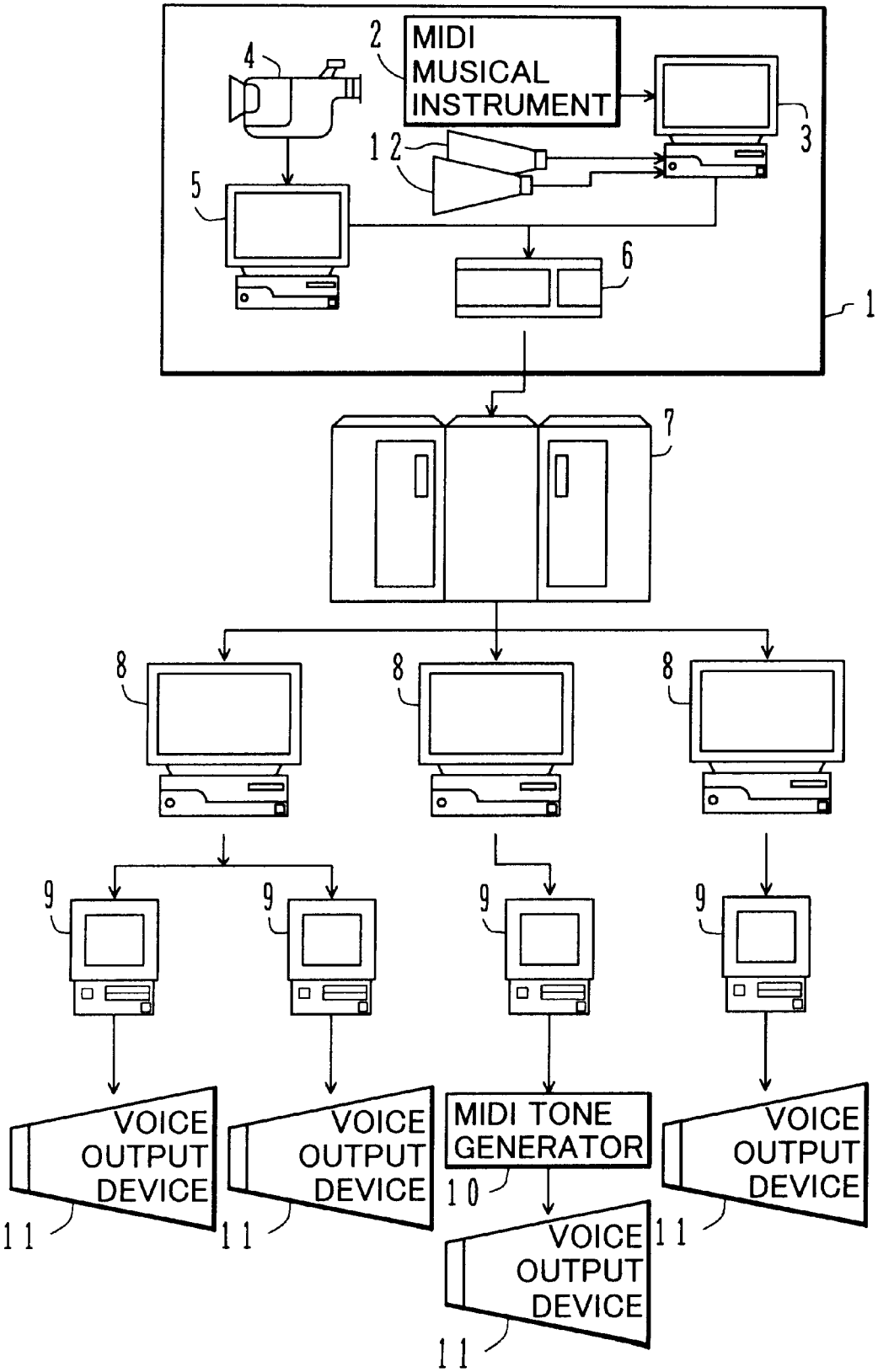
FIG. 1 is a schematic diagram showing a musical tone data communications network.

FIG. 1 is a block diagram showing a musical tone data communications network.

A concert hall 1 is installed with a MIDI musical instrument 2, a voice (including musical tone) input device 12, a camera 4, encoders 3 and 5, and a rooter 6. A player plays the MIDI musical instrument 2 in the concert hall 1, and a vocalist sings a song toward the voice input device 12 in accompaniment with the performance made by the player. Another voice input device 12 may be placed near a live drum (not shown).

The MIDI musical instrument 2 generates MIDI data in real time in accordance with the performance made by the player, and supplies it to the encoder 3. The voice input device 12 converts singing voices of the vocalist or sounds of the drum in real time into analog audio signals and supplies the audio signals to the encoder 3. The encoder 3 converts the analog audio signals in real time into digital audio data, and transmits each packet of MIDI data of a predetermined format in real time to the Internet via the rooter 6. The data format will be later described with reference to FIGS. 5A and 5B.

The camera 4 takes in real time an image of a player and supplies it as image data to the encoder 5. The encoder 5 transmits each packet of image data of a predetermined format to the Internet via the rooter 6.

The MIDI musical instrument 2 generates MIDI data in real time in accordance with the performance made by the player, and supplies it to the encoder 3. The voice input device 12 converts voices (singing voices or musical tone generated by a musical instrument) in real time into audio signals and supplies the audio signals to the encoder 3. The camera 4 takes in real time an image of the player and supplies it as image data to the encoder 5. The "real time" is preferably within a delay of 10 seconds or shorter, more preferably within a delay of 5 seconds or shorter, and most preferably within 3 seconds or shorter.

The encoders 3 and 5 generate packets of the MIDI data, audio data, and image data supplied in real time and transmit them to the Internet. This "real time" is preferably within a delay of 30 seconds or shorter, more preferably within a delay of 10 seconds or shorter, much more preferably within 5 seconds or shorter, and most preferably within 3 seconds or shorter.

The rooter 6 transmits MIDI data, audio data, and image data to the Internet to be described hereinunder. The data is supplied from the rooter 6 to a main server 7 via a public telephone line or a leased telephone line, and to a plurality of world wide web (WWW) servers 8 which are called providers.

A user can access the Internet by connecting its home computer 9 to the WWW server 8 to receive MIDI data, audio data, and image data. The home computer 9 has a display and a MIDI tone generator (sound generator) and is connected to a voice output device 11.

The home computer 9 supplies in real time the received MIDI data, audio data, and image data to reproduction devices (MIDI tone generator, audio output device 11, and display device). This "real time" is preferably within a delay of 30 seconds or shorter, more preferably within a delay of 10 seconds or shorter, much more preferably within 5 seconds or shorter, and most preferably within 3 seconds or shorter.

The image data is displayed on the display device. The MIDI data is converted by the MIDI tone generator into musical tone signals which are reproduced by the audio output device 11. The audio data is converted from digital signals into analog signals which are reproduced by the audio output device 11. The home computer 9 makes the MIDI data and audio data be reproduced synchronously. A synchronizing method will be later described. Sounds analogous to performance sounds and singing sounds in the concert hall 1 can be reproduced in real time from the audio output device 11.

If a MIDI tone generator 10 is connected externally to the home computer 9, the home computer 9 can make the MIDI tone generator 10 produce musical tone signals and make the audio output device 11 connected to the MIDI tone generator 10 reproduce sounds.

Since the MIDI data and audio data are more important for a user than image data, the MIDI data and audio data are processed with a priority over the image data. Although a user does not feel uneasy about the image data with poor image quality and smaller frame number, musical tone signals of the MIDI data and audio data are required to have a high quality.

Any user can listen to a musical performance and singing voices in real time by connecting the home computer 9 to the Internet while looking at each scene of the concert hall 1 on the display device at home without going to the concert hall 1. A number of users can enjoy at home the musical performance played in the remote concert hall 1.

MIDI data is transmitted from the concert hall 1 to each user so that each user can share a situation of the concert hall 1 as if the player is playing the electronic musical instrument at user home. The sound quality of MIDI data is not lowered by noises during communications.

Figure 2:
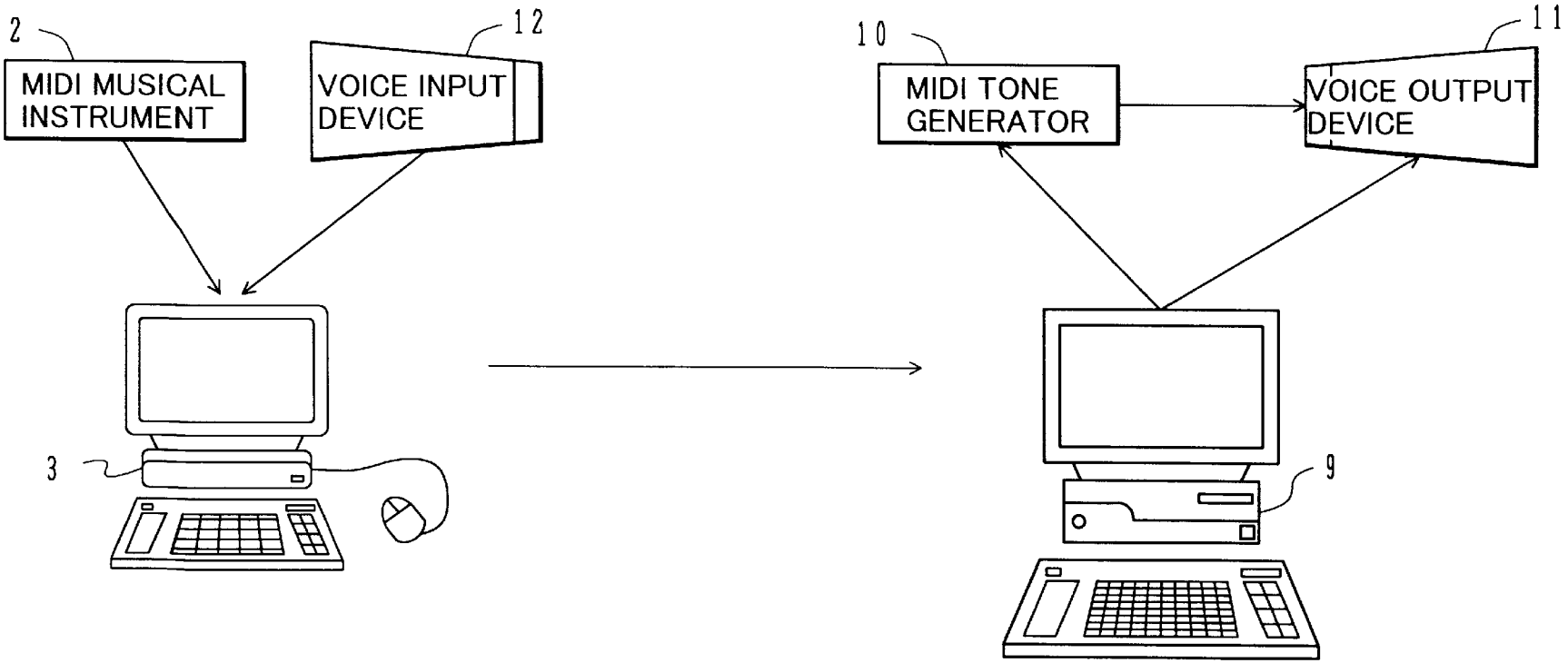
FIG. 2 is a block diagram showing interconnection between an encoder at a transmission side and a home computer at a reception side.

FIG. 2 shows the encoder 3 at the transmission side of the network and the home computer 9 at the reception side. For the convenience of the description of the relation between the encoder 3 and home computer 9, the encoder 3 is called a server 3 and the home computer 9 is called a client 9.

The server 3 and client 9 are connected by a digital line of the Internet. The server 3 receives MIDI data from the MIDI musical instrument 2 and analog audio signal from the voice input device 12. The audio data and MIDI data converted into digital data are transmitted from the server 3 to the client 9. The client 9 supplies the MIDI data to the MIDI tone generator 10, and supplies the audio data converted into analog audio data to the voice output unit 11. Upon reception of the MIDI data, the MIDI tone generator 10 generates analog musical tone signals and supplies them to the voice output device 11. The voice output device 11 receives and reproduces analog audio signals and musical tone signals.

Figure 3:
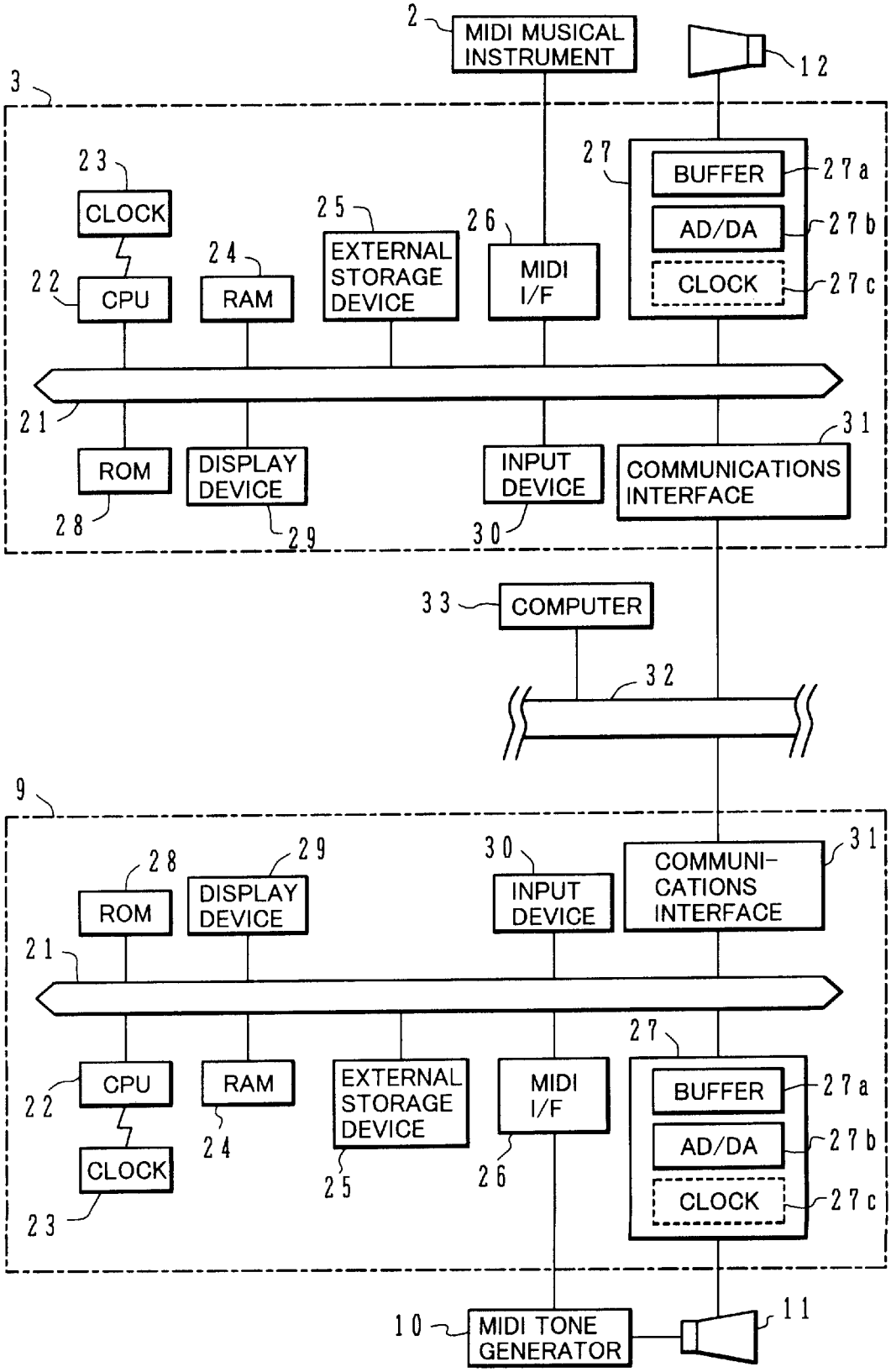
FIG. 3 is a block diagram showing the hardware structure of an encoder and a home computer.

FIG. 3 shows the hardware structure showing particulars of the structure shown in FIG. 2. The server 3 and client 9 may be a general computer, a personal computer or the like.

The server 3 and client 9 have basically the same structure. The common components of the server 3 and client 9 will be described. Connected to a bus 21 are a CPU 22, a RAM 24, an external storage device 25, a MIDI interface 26 for transferring MIDI data to and from an external circuitry, a sound card 27, a ROM 28, a display device 29, an input device 30 such as a keyboard and a mouse, a display device 27, and a communications interface 31 for connection to the Internet.

The sound card 27 has a buffer 27*a*, a coder/decoder (codec) circuit 27*b*, and a clock 27*c*. The buffer 27 buffers data to be transferred to and from an external circuitry. The codec circuit 27*b* has an A/D converter and a D/A converter for the conversion between analog and digital data. The clock 27*c* generates a sampling clock for the conversion. The sampling clock may be generated by a system clock 23. In this case, it is not necessary to provide the sound card 27 with the clock 27*c*.

The external storage device 25 may be a hard disk drive, a floppy disk drive, a compact disk read only memory (CD-ROM) drive, a magneto-optical disk drive or the like and may store therein MIDI data, audio data, image data, computer programs and the like.

ROM 28 may store therein computer programs, various parameters and the like. RAM 24 has a working area such as buffers and registers, and may copy and store the contents in the external storage device 25. In accordance with computer programs stored in ROM 28 or RAM 24, CPU 22 performs various calculations and signal processing. CPU 23 can fetch timing information from a system clock 23 to perform a timer interrupt process. The system clock generates timing information to synchronize the MIDI data and audio data.

The communication interfaces 31 of the server 3 and client 9 are connected to an Internet line 32. The communications interface 31 transfers MIDI data, audio data, and image data to and from the Internet. The server 3 and client 9 are connected via the Internet line 32.

The server 3 will be described first. The MIDI musical instrument 2 is connected to the MIDI interface 26, and the voice input device 12 is connected to the sound card 27. The MIDI musical instrument 2 generates MIDI data in accordance with the performance made by a player, and outputs it to the MIDI interface 26. The voice input device 12 receives sounds in a concert hall and outputs analog audio signals to the sound card 27. The sound card 27 converts analog audio signals into digital audio signals.

Figure 4A:
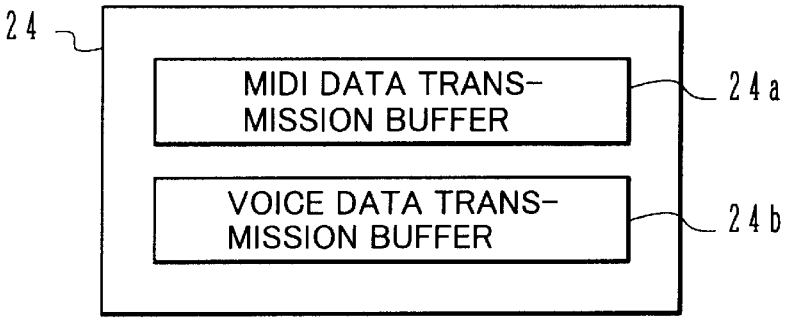
FIG. 4A shows the contents of a RAM in an encoder.

As shown in FIG. 4A, RAM 24 of the server 3 has a MIDI data transmission buffer 24*a* and an audio data transmission buffer 24*b*. MIDI data input to the MIDI interface 26 (FIG. 3) is stored in the MIDI data transmission buffer 24*a*. Audio data input to the sound card 27 (FIG. 3) is stored in the audio, data transmission buffer 24*b*. CPU 22 (FIG. 3) reads the MIDI data and audio data from the transmission buffers 24*a* and 24*b*, and transmits them via the communications interface 31 (FIG. 3) to the Internet line 32 (FIG. 3) in the form of packet.

The client 9 will be described next. As shown in FIG. 3, the MIDI interface 26 is connected to the MIDI tone generator 10, and the sound card 27 is connected to the voice output device 11. CPU 22 receives MIDI data, audio data, and image data from the Internet line 32 via the communications interface 31.

Figure 4B:
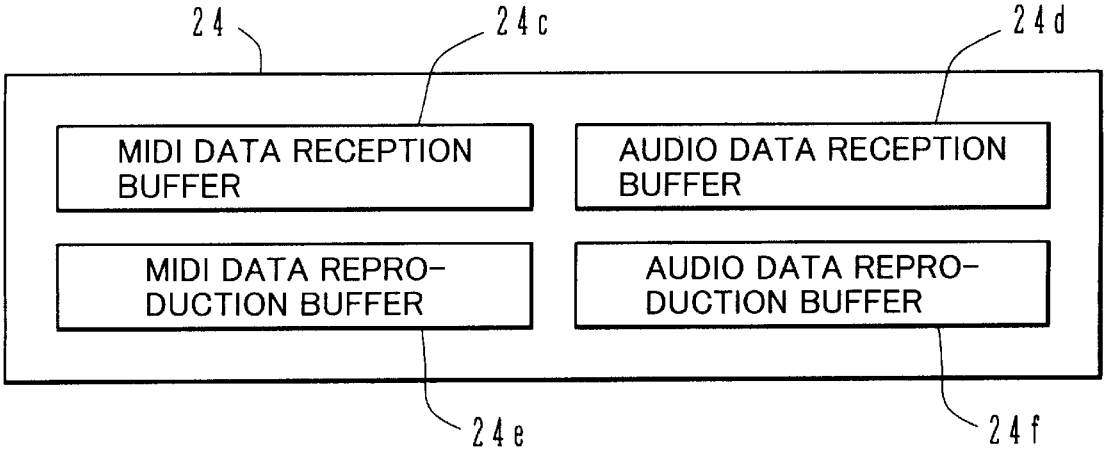
FIG. 4B shows the contents of a RAM in a home computer.

As shown in FIG. 4B, RAM 24 of the client 9 has a MIDI data reception buffer 24*c*, an audio data reception buffer 24*d*, a MIDI data reproduction buffer 24*e*, and an audio data reproduction buffer 24*f*. The MIDI data reception buffer 24*c* buffers received MIDI data, and the audio data reception buffer 24*d* buffers received audio data.

CPU 22 (FIG. 3) transfers MIDI data in the MIDI data reception buffer 24*c* to the MIDI data reproduction buffer 24E, and transfers audio data in the audio data reception buffer 24*d* to the audio data reproduction buffer 24*f*. MIDI data or audio data is stored in the reproduction buffer 24*e* or 24*f* in the order of smaller address. Each address of the reproduction buffer 24*e*, 24*f* represents also time information. Namely, the address axis corresponds to a time axis.

MIDI data in the reproduction buffer 24*e* is output to the MIDI tone generator 10 via the MIDI interface 26 shown in FIG. 3. Upon reception of the MIDI data, the MIDI tone generator 10 generates a musical tone signal and outputs it to the voice output device 11. The sound card 27 converts digital audio data in the reproduction buffer 24*f* into analog audio data and outputs it to the voice output device 11. The voice output devices 11 received the musical tone signal and audio signal reproduce them.

The communications interface 31 shown in FIG. 3 is used for the connection to various networks, and may be an Ethernet interface, an IEEE 1394 digital communications interface, or an RS-232C interface, instead of an Internet interface.

The server 3 stores computer programs to be used for transmitting MIDI data or other data. The client 9 stores computer programs to be used for receiving MIDI data or other data.

The CD-ROM drive reads computer programs and other data stored in a CD-ROM. The read computer programs and other data are stored in a hard disk. In this manner, new installation, version-up and the like of computer programs can be performed easily.

The communications interface 31 is connected to a communications network 32 such as the Internet, a local area network (LAN) and a telephone line, and via the communications network 32 to a computer 33. If application programs and other data are not stored in the external storage device 25, these programs and data can be downloaded from the computer 33. In this case, the server 3 or client 9 transmits a command for downloading an application program or data to the computer 33 via the communications interface 31 and communications network 32. Upon reception of this command, the computer 33 supplies the requested application program or data to the server 3 or client 9 via the communications network 32, and the server 3 or client 9 receives it via the communications interface 31 and stores it in the external storage device 25.

This embodiment may be reduced into practice by a commercially available personal computer installed with application programs and various data realizing the functions of the embodiment. The application programs and various data may be supplied to a user in the form of a storage medium such as a CD-ROM and a floppy disk which the personal computer can read. If the personal computer is connected to the communications network such as the Internet, a LAN and a telephone line, the application programs and various data may be supplied to the personal computer via the communications network.

In addition to a personal computer, the server 3 or client 9 may be an electronic musical instrument, a game machine, a karaoke machine, a television or the like.

Figure 5A:
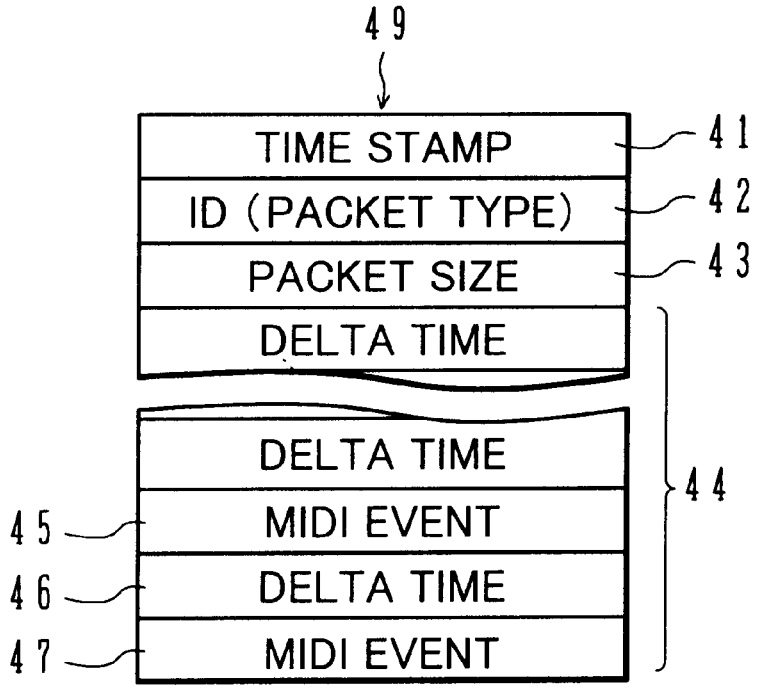
FIG. 5A shows the structure of a MIDI data packet.

FIG. 5A shows the structure of a MIDI data packet 49 to be transmitted from the server 3.

The MIDI data packet 49 is constituted of a time stamp 41 used for synchronization, an identifier (ID) 42 indicating that this packet is MIDI data, a packet size 43, and MIDI data 44.

The time stamp 41 indicates, for example, a transmission time of the MIDI data 44 in the packet. Instead of the transmission time, the time stamp 41 may indicate a performance time, a record time, or a reproduction time. The identifier 42 discriminates between the types of packets including a MIDI data packet, an audio data packet, an image data packet, and the like. In the example shown in FIG. 5A, the identifier 42 indicates the MIDI data packet.

The MIDI data 44 conforms with the standard MIDI file format and is a data train of pairs of delta time (interval) and an MIDI event. The delta time 46 between MIDI events 45 and 47 indicates a time duration between the MIDI events 45 and 47. If the delta time is 0, this may be omitted.

Figure 5B:
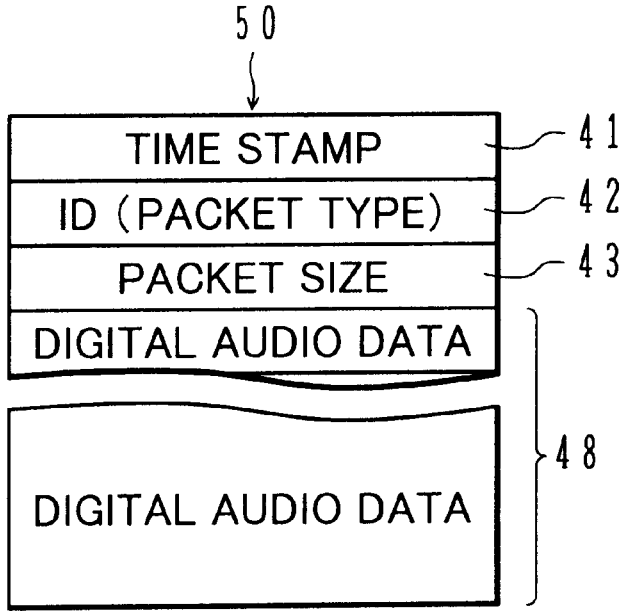
FIG. 5B shows the structure of an audio data packet.

FIG. 5B shows the structure of an audio data packet 50 to be transmitted from the server 3.

The audio data packet 50 is constituted of a time stamp 41 used for synchronization, an identifier (ID) 42 indicating that this packet is audio data, a packet size 43, and audio data 44.

Similar to the MIDI data packet, the time stamp 41 indicates a transmission time or the like of audio data 48 in the packet. The digital audio data 48 is generated by the voice input device 12 (FIG. 3).

Next, the method of synchronizing the MIDI data and audio data will be described. Both the MIDI data packet 49 and audio data packet 50 have the time stamp 41.

Both the time stamps 41 are time information on the same time axis generated by the system clock 23 (FIG. 3), the time information indicating a lapse time from the performance start. For example, assuming that a concert starts at 21:00 (21 hour: 00 minute) and ends at 22:00, the time stamp is 0:0:0:00 (21 hour: 0 minute: 0 second: 00 centi-second) at the concert start, and 1:0:0:00 (22 hour: 0 minute: 0 second: 00 centi-second) at the concert end.

In accordance with the time stamp 41 received from the server 3, the client 9 counts time to know a lapse time from the concert start. By using the lapse time, MIDI data and audio data can be synchronized as will be later detailed.

Even if the MIDI data and audio data are synchronized at the reproduction start, the timings therebetween may be shifted thereafter. For example, clocks used for generating MIDI data and clocks used for generating audio data become asynchronous or have different frequencies, in some cases. Specifically, referring to FIG. 3, clocks 23 used by the MIDI interface 26 for receiving MIDI data from the MIDI musical instrument 2 and clocks 27*c* used by the sound card 27 for A/D conversion become asynchronous or have different frequencies, in some cases. In such a case, even if the MIDI data and audio data are synchronized at the reproduction start, the timings therebetween shift as the time lapses. At the same time, the timings at the server 3 and client 9 shift.

Similarly, the timings shift also if there are errors in the clocks of the server 3 and client 9.

Next, a method of synchronizing the MIDI data and audio data not only at the reproduction start but also periodically thereafter, in order to suppress or eliminate the timing shift, will be described.

First, a method of periodically synchronizing MIDI data will be described. By using the time stamp in the MIDI data packet as an initial value, time is counted at a predetermined time step to acquire a reproduction lapse time of current MIDI data. This time may shift from another reproduction lapse time corresponding to the address of the MIDI data reproduction buffer 24*e* (FIG. 4B). This shift is compensated to synchronize the MIDI data. A method of compensating for a timing shift of the MIDI data will be described later with reference to FIGS. 7A to 7C.

Similarly, by using the time stamp in the audio data packet as an initial value, time is counted at a predetermined time step to acquire a reproduction lapse time of current audio data. This time may shift from another reproduction lapse time corresponding to the address of the audio data reproduction buffer 24*f* (FIG. 4B). This shift is compensated to synchronize the audio data. A method of compensating for a timing shift of the audio data will be described with reference to FIG. 6.

Figure 6:
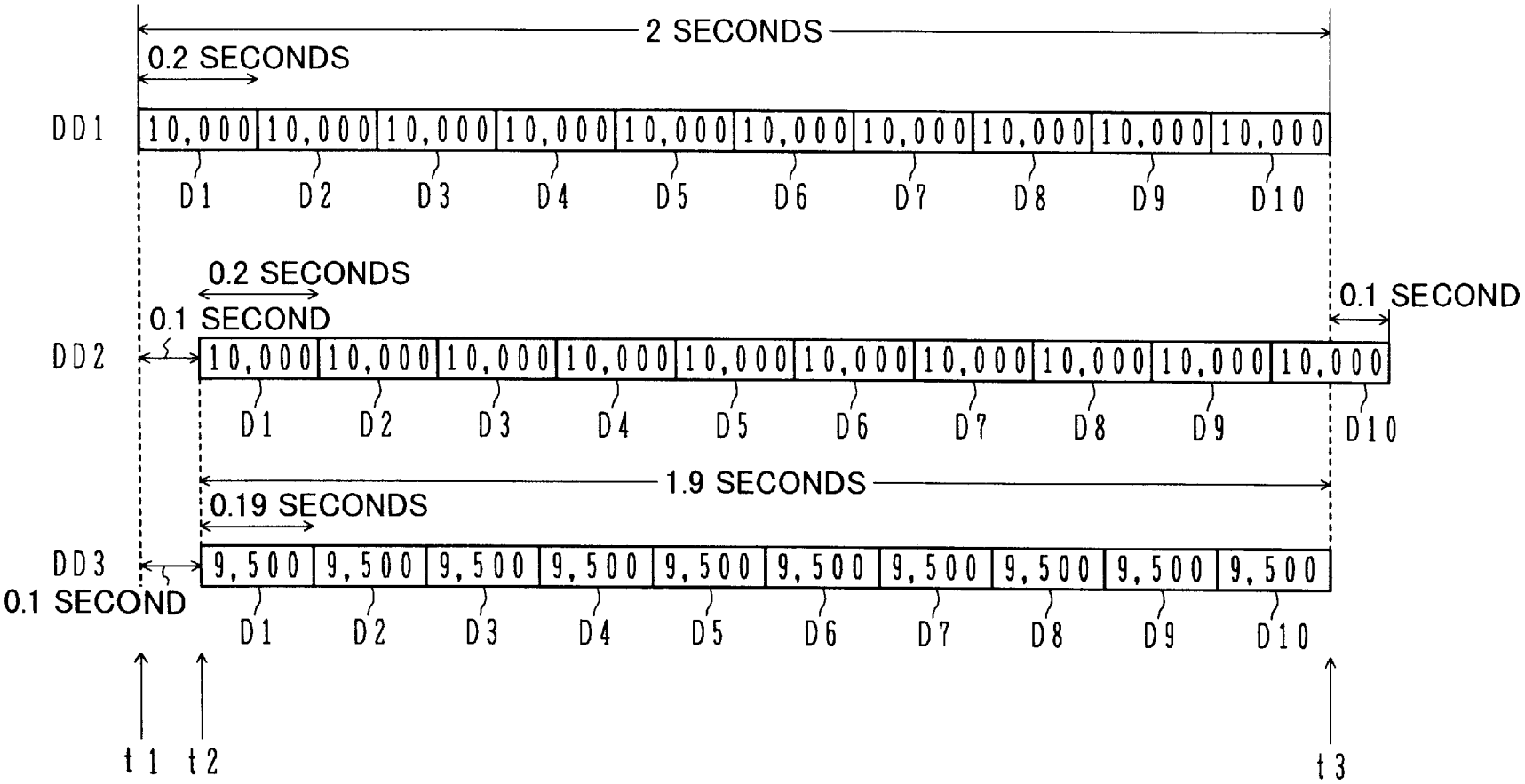
FIG. 6 is a timing chart illustrating a timing adjusting method for audio data.

FIG. 6 illustrates a method of compensating for an audio data timing shift. The abscissa represents a time. The audio data and MIDI data are synchronized at a time interval of, for example, 2 seconds. Namely, it is checked at a time interval of 2 seconds whether there is any shift between reproduction lapse times, and if there is a shift, this shift is compensated.

The audio data DD1 shown in FIG. 6 continues for 2 seconds which are the correct reproduction time duration. The audio data DD1 starts at a timing t1 and ends at a timing t3. For example, the server 3 transmits the audio data DD1 as ten packets of audio data sets D1 to D10 each continuing for 0.2 seconds. If the sampling rate of the audio data is 50 kHz, sampling is performed every 0.02 ms. Each of the audio data sets D1 to D10 continues for 0.2 seconds so that it has 10,000 sampling points.

It is assumed that audio data DD2 actually reproduced starts at a timing t2 delayed by 0.1 second from the start of the original audio data DD1. In this case, the audio data DD2 is changed to audio data DD3, and this audio data DD3 is reproduced in place of the audio data DD2. More specifically, each data set D1 to D10 in the audio data DD2 is thinned by 50 sampling points to generate the audio data DD3. In this case, one point is thinned at every 20 points.

Each data set D1 to D10 of the audio data DD3 has therefore 9,500 points and a reproduction time of 0.19 seconds. The audio data DD3 having ten data sets D1 to D10 has therefore a reproduction time of 1.9 seconds.

The audio data DD3 has a reproduction time shorter by 0.1 second than the audio data DD2. Therefore, a delay of the audio data can be recovered. Namely, although the start (timing t2) of the audio data DD3 is delayed by 0.1 second from the audio data DD1, there is no delay at the end (timing t3). If the synchronization is performed every two seconds, a delay is recovered during two seconds.

Conversely, if the audio data is reproduced earlier by 0.1 second, one point is thinned at every 20 points so that each packet has 10,500 points. For example, this thinning is performed by averaging adjacent data to obtain an interpolated value.

Figure 7A:
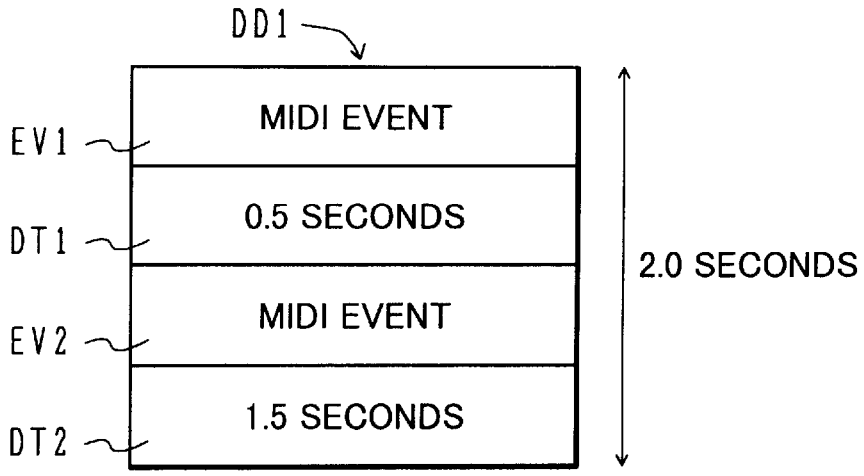
FIGS. 7A to 7C are diagrams illustrating a timing adjusting method for MIDI data.
Figure 7B:
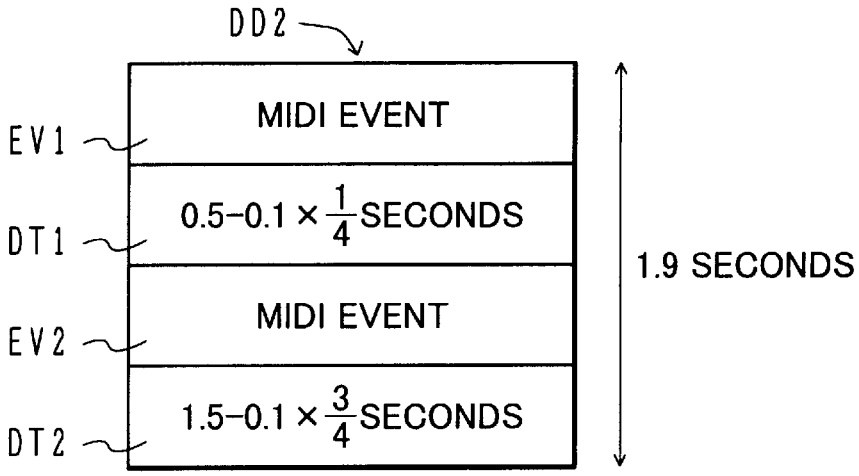
Figure 7C:
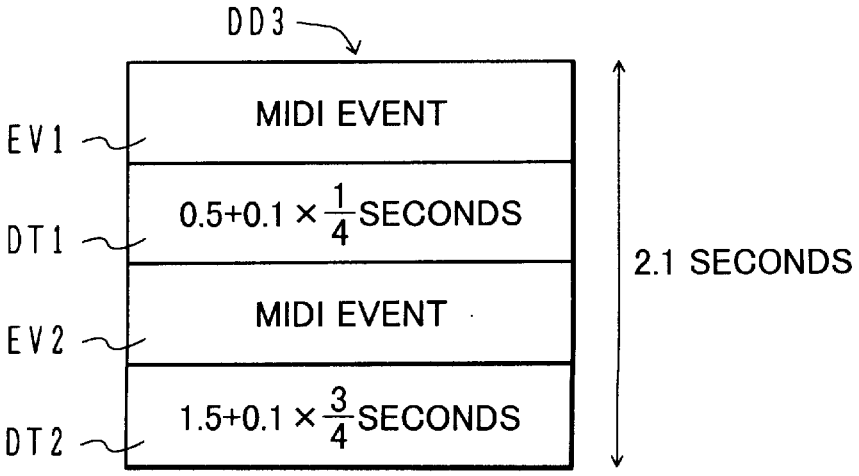

FIGS. 7A to 7C illustrate a method of compensating for a MIDI data timing shift. MIDI data corresponds to the MIDI data 44 shown in FIG. 5A. For example, the MIDI data and audio data are synchronized every two seconds.

As shown in FIG. 7A, MIDI data DD1 has a MIDI event EV1, a delta time (0.5 seconds) DT1, a MIDI event EV2, and a delta time (1.5 seconds) DT2. The reproduction time of the MIDI data DD1 is a total sum of the delta time (0.5 seconds) DT1 and delta time (1.5 seconds) DT2, which sum is 2 seconds.

If the MIDI data DD1 delays 0.1 second in total, the MIDI data DD1 is changed to MIDI data DD2 shown in FIG. 7B. The MIDI data DD2 has a delta time DT1 of 0.5−0.1×¼ seconds and a delta time DT2 of 1.5−0.1×¾ seconds. The delta times DT1 and DT2 are changed by amounts proportional to their original time durations. Namely, the delta time DT1 is shortened by 0.1×¼ (=0.1×0.5/(0.5+1.5)), and the delta time DT2 is shortened by 0.1×¾ (=0.1×1.5/(0.5+1.5)). The MIDI data DD2 is shortened by 0.1 second as compared to the MIDI data DD1, and its reproduction time is 1.9 seconds. Therefore, the MIDI data DD2 can recover a delay of 0.1 second.

Conversely, if MIDI data DD1 advances by 0.1 second, the MIDI data DD1 is changed to the MIDI data DD3 shown in FIG. 7C. The MIDI data DD3 has a delta time DT1 of 0.5+0.1×¼ seconds and a delta time DT2 of 1.5+0.1×¾ seconds. The MIDI data DD3 is elongated by 0.1 second as compared to the MIDI data DD1, and its reproduction time becomes 2.1 seconds. Therefore, the MIDI data DD3 can recover an advance of 0.1 second.

Figure 8:
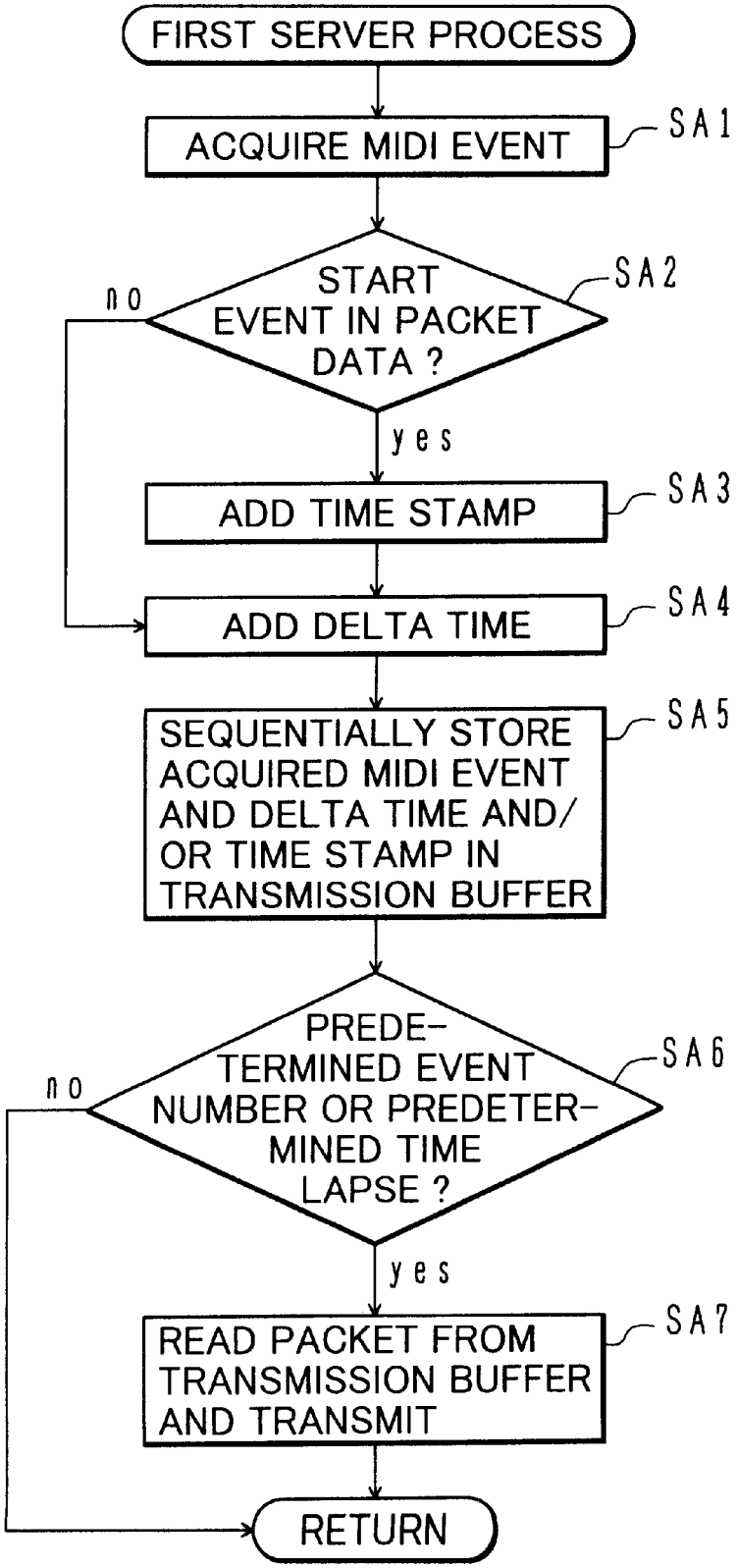
FIG. 8 is a flow chart illustrating a first process of a server.

FIG. 8 is a flow chart illustrating the first process to be executed by the server 3.

At Step SA1, a MIDI event is acquired. Namely, as shown in FIG. 3, a MIDI event is acquired from the MIDI musical instrument 2 via the MIDI interface 26.

At Step SA2 it is checked whether the MIDI event is a start event in the packet data, i.e., whether the MIDI event is a start event in the packet to be transmitted. If the MIDI event is the start event, the flow follows an yes arrow to advance to Step SA3, whereas if not, the flow follows a no arrow to bypass Step SA3 and skip to Step SA4.

At Step SA3, a time stamp is added. The time stamp indicates a lapse time from the performance start (or record start) and corresponds to the performance timing for the data in the packet. Thereafter, the flow advances to Step SA4.

At Step SA4, a delta time is added. The delta time is a time duration between the preceding and succeeding MIDI events.

At Step SA5, the acquired MIDI event and the delta time and/or time stamp are sequentially stored in the transmission buffer 24*a* (FIG. 4A). If the MIDI event is the start event in the packet, the time stamp, delta time, and acquired MIDI event are stored in the transmission buffer 24*a*, whereas if not, the delta time and acquired MIDI event are stored in the transmission buffer 24*a*.

At Step SA6 it is checked whether the number of MIDI events exceeds a predetermined value or whether the time has lapsed by a predetermine time duration. In accordance with the number of MIDI events or time, the size of a packet is determined. If the conditions at Step SA6 are not satisfied, the flow follows a no arrow to terminate the first process. If the next MIDI event is entered thereafter, the above processes are repeated starting from Step SA1. If the conditions at Step SA6 are satisfied, the flow follows a yes arrow to advance to Step SA7.

At Step SA7, a packet is read from the transmission buffer and transmitted. Specifically, as shown in FIG. 5A, a packet including the time stamp 41, identifier 42, packet size 43, and MIDI data 44 is transmitted. The size of the packet is about 500 bytes for example. The server 3 terminates thereafter the first process.

Figure 9:
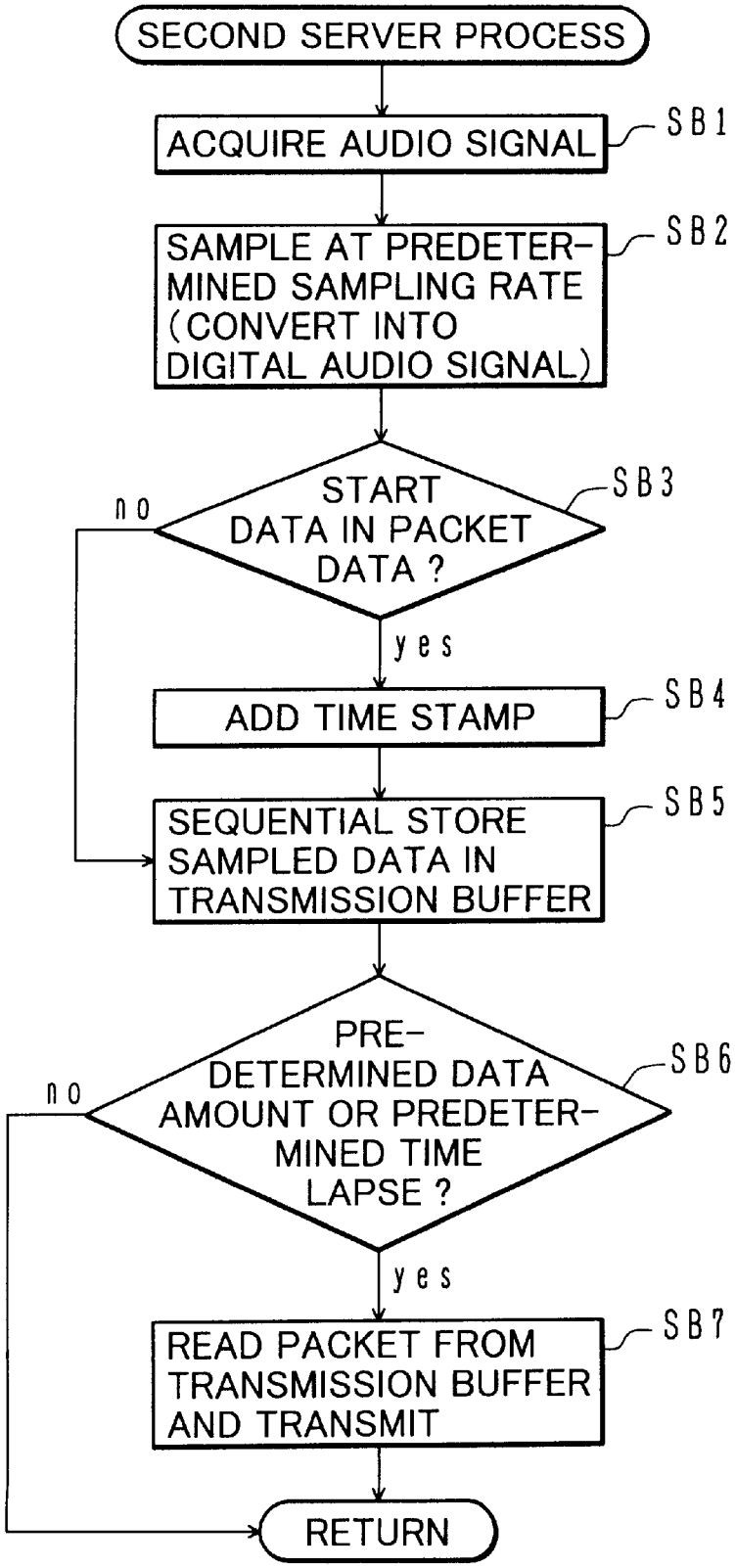
FIG. 9 is a flow chart illustrating a second process of the server.

FIG. 9 is a flow chart illustrating the second process to be executed by the server 3.

At Step SB1, audio signals are acquired from the voice input device 12 (FIG. 3).

At Step SB2, an audio signal is sampled at a predetermined sampling rate. Specifically, the sound card 27 (FIG. 3) A/D converts the audio signal into a digital audio signal.

At Step SB3 it is checked whether the audio data is start data in the packet data. If the audio data is the start data, the flow follows an yes arrow to advance to Step SB4, whereas if not, the flow follows a no arrow to bypass Step SB4 and skip to Step SAB5.

At Step SB4, a time stamp is added. The time stamp indicates a lapse time from the performance start (or record start) and corresponds to the performance timing for the data in the packet. Thereafter, the flow advances to Step SB5.

At Step SB5, the sampled audio data is sequentially stored in the transmission buffer 24*b* (FIG. 4A). If the audio data is the start data in the packet, the time stamp and audio data are stored in the transmission buffer 24*b*.

At Step SB6 it is checked whether the amount of audio data exceeds a predetermined value or whether the time has lapsed by a predetermine time duration. If the conditions at Step SB6 are not satisfied, the flow follows a no arrow to terminate the second process. If the next audio signal is entered thereafter, the above processes are repeated starting from Step SB1. If the conditions at Step SB6 are satisfied, the flow follows a yes arrow to advance to Step SB7.

At Step SB7, a packet is read from the transmission buffer 24*b* and transmitted. Specifically, as shown in FIG. 5B, a packet including the time stamp 41, identifier 42, packet size 43, and audio data 48 is transmitted. The server 3 terminates thereafter the second process.

Figure 10:
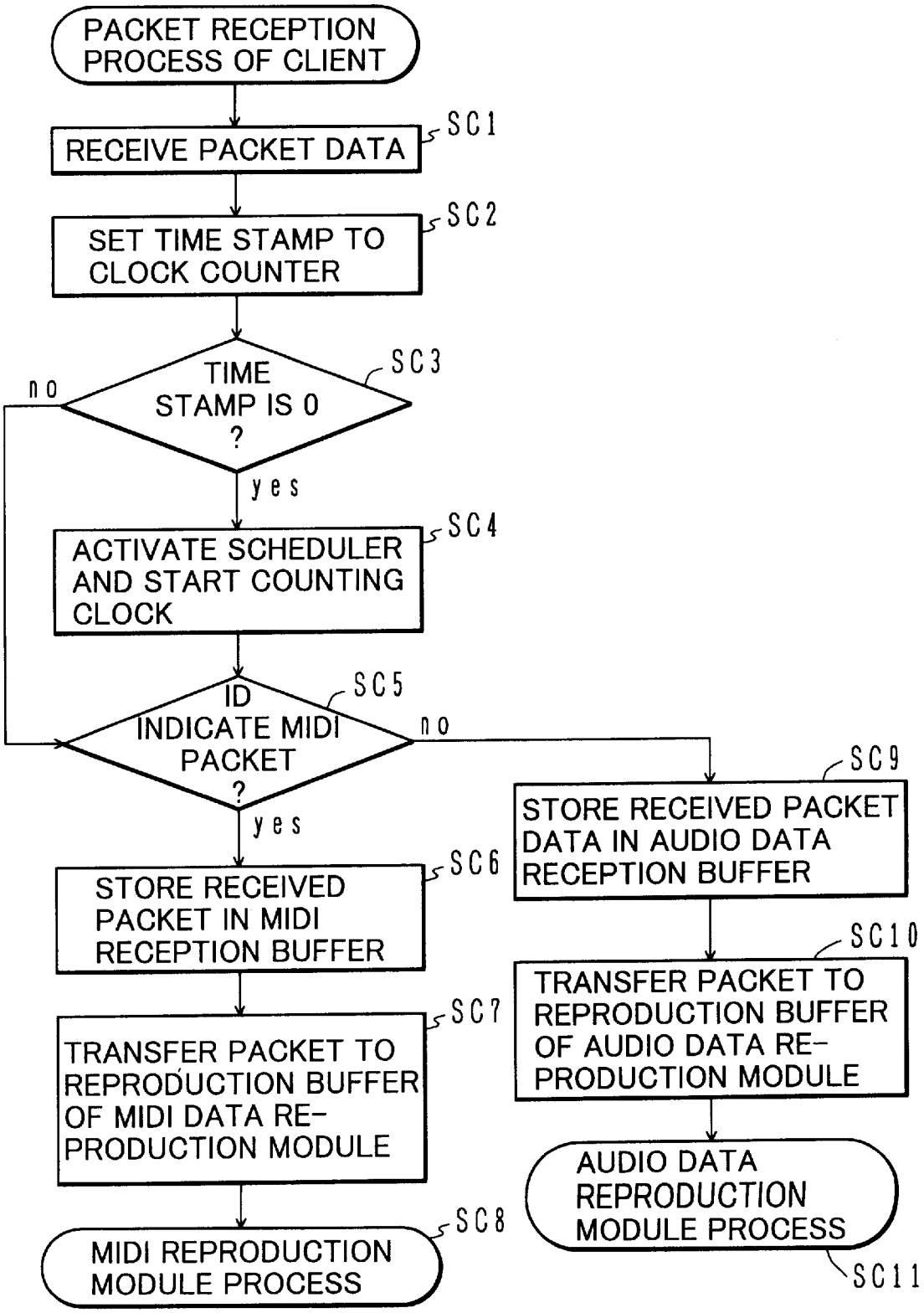
FIG. 10 is a flow chart illustrating a packet reception process at a client side.

FIG. 10 is a flow chart illustrating a packet reception process to be executed by the client 9.

At Step SC1, packet data is received via the communications interface 31 (FIG. 3).

At Step SC2, the value of the time stamp in the packet is set to a clock counter. Thereafter, the system clock of the client 9 periodically increments the value of the clock counter.

At Step SC3 it is checked whether the time stamp is 0. If the start packet is received, the time stamp in the packet is 0. If 0, the flow follows a yes arrow to advance to Step SC4, whereas if not 0, the flow follows a no arrow to bypass Step SC4 and skip to Step SC5.

Figure 12:
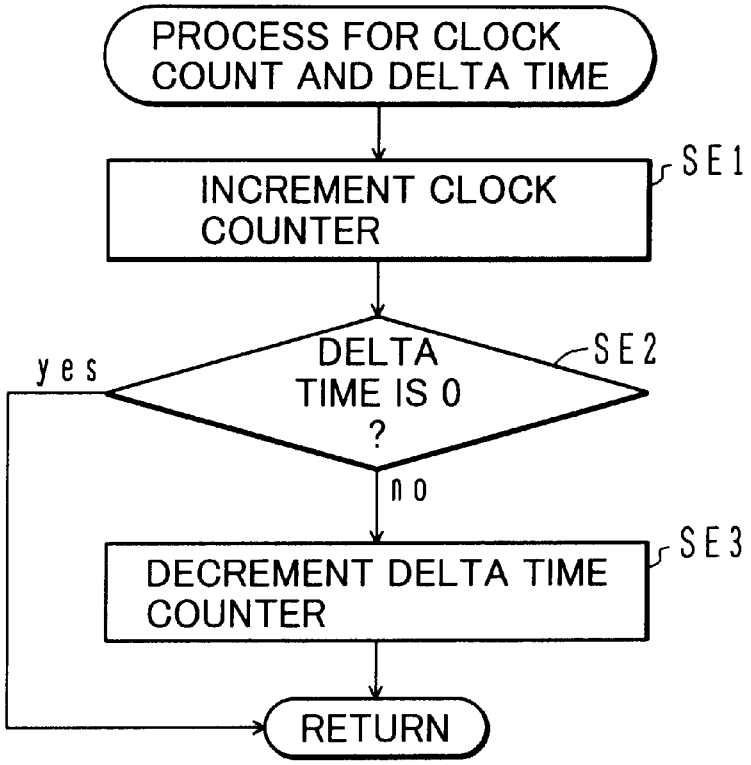
FIG. 12 is a flow chart illustrating an interrupt process.

At Step SC4, a scheduler is activated to start counting a clock by the clock counter. The scheduler is an interrupt process for synchronizing MIDI data and audio data, the details of which will be later described with reference to the flow chart of FIG. 14. The clock counting is performed by an interrupt process at a predetermined time interval as illustrated in the flow chart of FIG. 12. At Step SE1, the value of the clock counter is incremented. The value of the clock counter is initially set at Step SC2 shown in FIG. 10, and thereafter incremented at a predetermined time interval. Steps SE2 and SE3 will be later described. Thereafter, the flow advances to Step SC5 shown in FIG. 10.

At Step SC5 it is checked whether the identifier (ID) in the packet indicates a MIDI data packet. If so, the flow follows a yes arrow to advance to Step SC6 whereat the MIDI data packet is processed, whereas if not, it means the audio data packet and the flow follows a no arrow to advance to Step SC9. This flow chart illustrates a process of synchronizing MIDI data and audio data. However, if the identifier (ID) in the packet indicates an image data packet, a process of reproducing the image data is performed.

At Step SC6, the received packet data is stored in the MIDI reception buffer 24*c* (FIG. 4B).

Next, at Step SC7 the packet in the reception buffer is transferred to the MIDI data reproduction buffer 24*e* (FIG. 4B). The MIDI data reproduction buffer 24*e* is a buffer used by a MIDI reproduction module to perform a reproduction process. The address of this buffer corresponds to a time.

Thereafter, a MIDI reproduction module process is performed at Step SC8, the details of which will be later described with reference to the flow chart shown in FIG. 11.

Next, an audio data process will be described. At Step SC9, the received packet data is stored in the audio data reception buffer 24*d* (FIG. 4B) to thereafter advance to Step SC10.

At Step SC10, the packet in the reception buffer is transferred to the audio data reproduction buffer 24*f* (FIG. 4B). The audio data reproduction buffer 24*f* is a buffer for an audio data reproduction module to reproduce audio data, and the address of this buffer corresponds to a time.

Thereafter, at Step SC11 an audio data reproduction module process is performed, the details of which will be later described with reference to the flow chart shown in FIG. 13.

Figure 11:
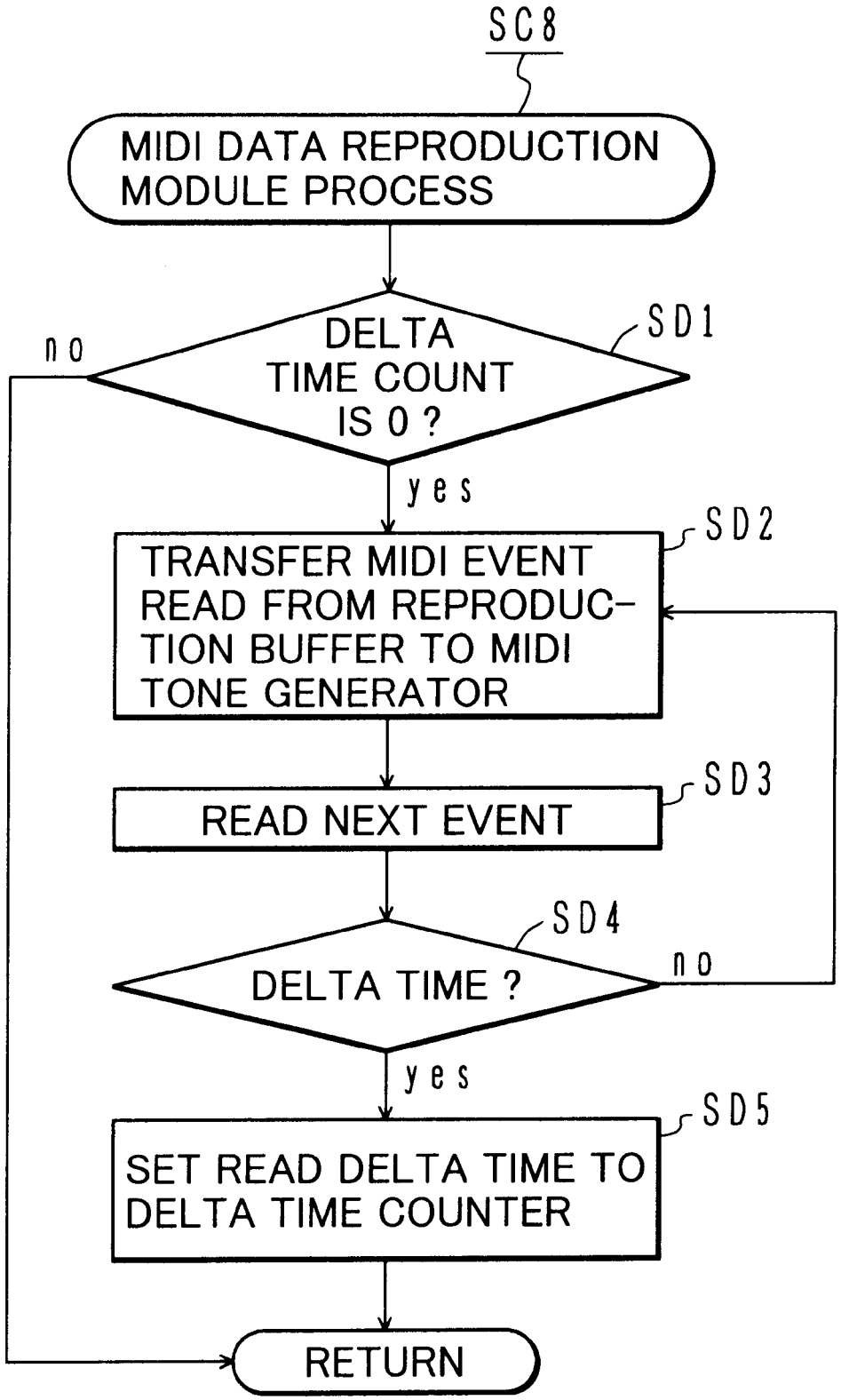
FIG. 11 is a flow chart illustrating the details of a MIDI data reproduction module process at Step SC8 shown in FIG. 10.

FIG. 11 is a flow chart illustrating the details of the MIDI reproduction module process at Step SC8 shown in FIG. 10. This process performs a MIDI event reproduction process, similar to the process of the sequencer.

At Step SD1 it is checked whether the value of a counter for the delta time is 0. First, the value of the delta time in the packet is read and set to the counter. Thereafter, the delta time is decremented by the interrupt process illustrated in FIG. 12 in response to a system clock of the client 9. Specifically, at Step SE2 it is checked whether the value of the counter for the delta time is 0. If not 0, the flow follows a no arrow to advance to Step SE3 whereat the count of the delta time is decremented to thereafter return to the process executed before the interrupt process. If 0, the flow follows a yes arrow to bypass Step SE3 and return to the process executed before the interrupt process.

Reverting to FIG. 11, if the count of the delta time is not 0 at Step SD1, it means that it is still not the reproduction timing. In this case, the flow follows a no arrow to terminate the MIDI data reproduction module process.

If it is judged at Step SD1 that the count of the delta time is 0, it means that it is the reproduction timing. In this case, the flow follows a yes arrow to advance to Step SD2.

At Step SD2, the MIDI event read from the reproduction buffer is transferred to the MIDI tone generator 10 (FIG. 3). As shown in FIG. 3, the MIDI tone generator 10 generates a musical tone signal in accordance with the MIDI event, and the voice output device 11 reproduces the musical tone signal.

At Step SD3, the next event is read from the reproduction buffer. This event is the MIDI event or delta time.

At Step SD4 it is checked whether the read event is a delta time. If not, it means the MIDI event, and the flow follows a no arrow to return to Step SD2 whereat the read MIDI event is transferred to the MIDI tone generator 10, whereas if the read event is the de1 time, the flow follows a yes arrow to advance to Step SD5.

At Step SD5, the read delta time is set to the delta time counter. The value of the delta time counter is decremented by the interrupt process illustrated in FIG. 12. After the above operations, the MIDI data reproduction module process is terminated.

The MIDI data reproduction module process is performed not only when the MIDI data packet is received but also it is performed periodically by the interrupt process. By periodically performing the MIDI data reproduction module process to reproduce the data in the reproduction buffer, it is possible to perform the reproduction process at a predetermined resolution.

Figure 13:
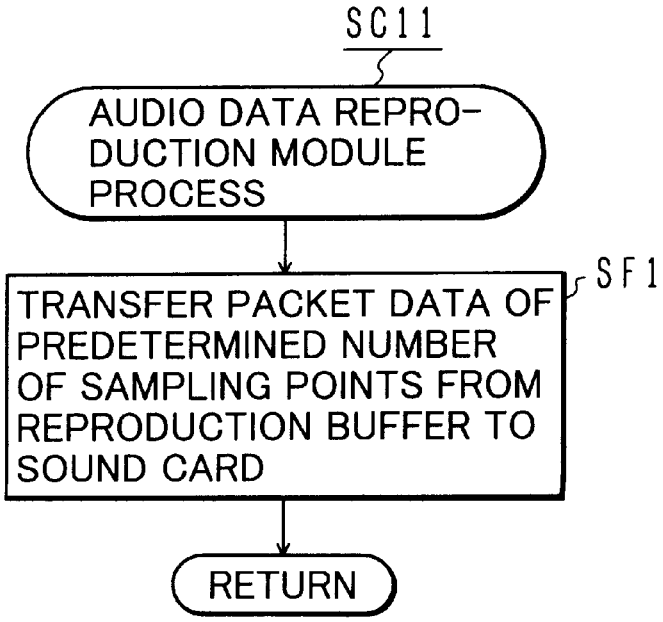
FIG. 13 is a flow chart illustrating the details of an audio data reproduction module process at Step SC11 shown in FIG. 10.

FIG. 13 is a flow chart illustrating the details of the audio data reproduction module process at Step SC11 shown in FIG. 10.

At Step SF1, packet data of a predetermined number of sample points is transferred from the audio data reproduction buffer 24*f* (FIG. 4B) to the sound card 27 (FIG. 3). The sound card 27 converts the digital audio data into analog audio data. The sound output device 11 (FIG. 3) reproduces the audio signal. After the above operations, the audio data reproduction module process is terminated.

The audio data reproduction module process is performed not only when the audio data packet is received but also it is performed periodically by the interrupt process. By periodically performing the audio data reproduction module process to reproduce the data in the reproduction buffer, it is possible to perform the reproduction process at a predetermined resolution.

Figure 14:
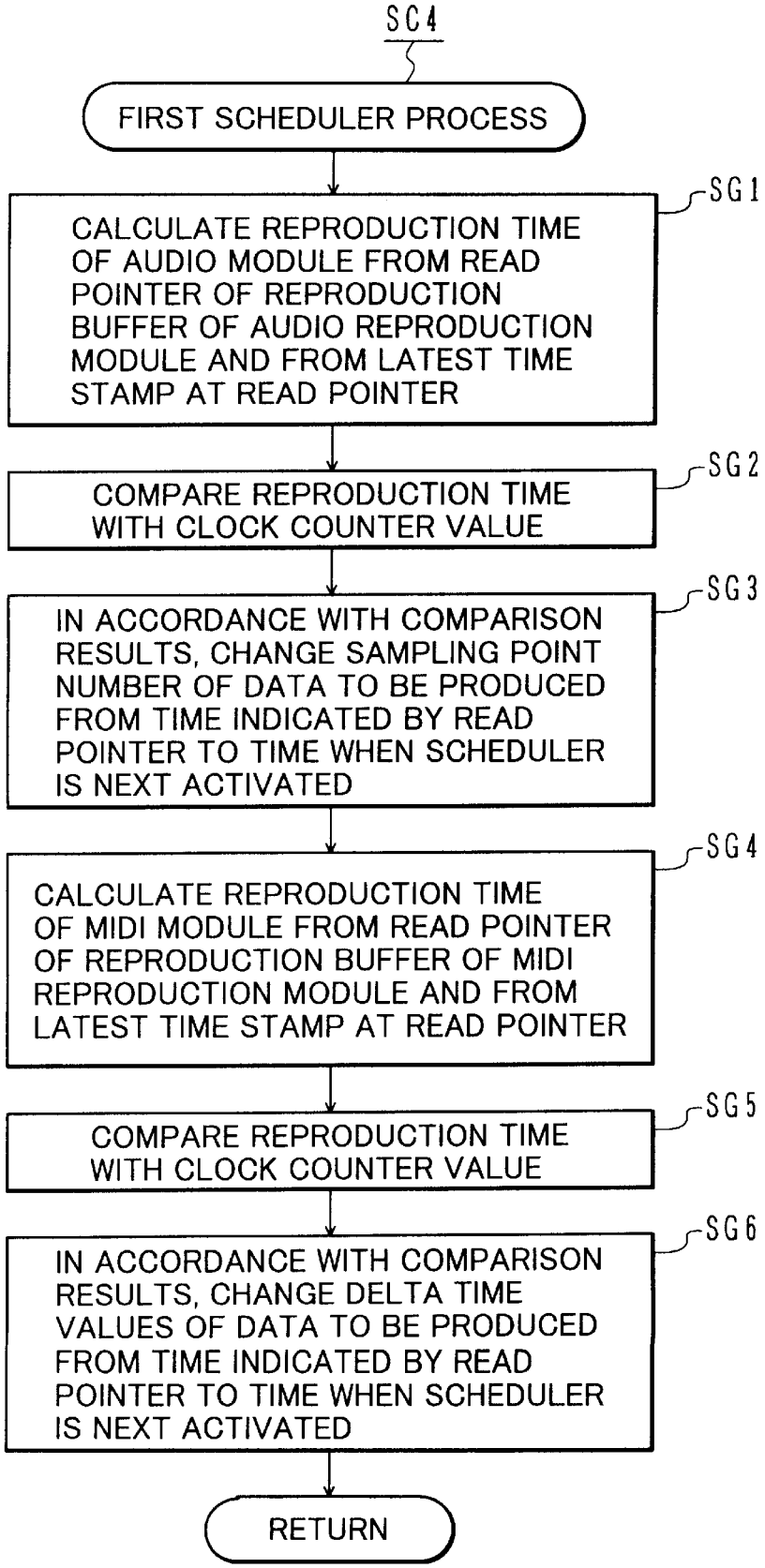
FIG. 14 is a flow chart illustrating a first scheduler process.

FIG. 14 is a flow chart illustrating the details of a first scheduler process at Step SC4 shown in FIG. 10. This process is activated periodically (e.g., at an interval of 2 seconds) by the interrupt process to thereby synchronize MIDI data and audio data.

At Step SG1, a reproduction time of audio data is calculated. First, a read pointer (address) of the audio data reproduction buffer 24*f* (FIG. 4B) is acquired and converted into time information. The reproduction buffer is used for the audio data reproduction module (FIG. 13) to reproduce the audio data, and the address thereof corresponds to a reproduction time. Next, the latest time stamp is acquired at the read pointer. Then, the times indicated by the time stamp and read pointer are added together to obtain a reproduction time.

At Step SG2, the reproduction time is compared with the value of the clock counter. The value of the clock counter was initially set to the value of the time stamp at Step SC2 shown in FIG. 10, and thereafter incremented by the interrupt process shown in FIG. 12. If the comparison result shows that both the reproduction time and the value of the clock counter are the same, the timing of the audio data is correct, whereas if they are different, it means that the timing of the audio data was shifted.

At Step SG3, in accordance with the comparison results, the number of sampling points of the audio data is adjusted as shown in FIG. 6 to compensate for the timing shift of the audio data. Namely, the sampling points of the data to be reproduced from the time indicated by the read pointer to the time when the scheduler is next activated, are changed.

At Step SG4, a reproduction time of MIDI data is calculated. First, a read pointer (address) of the MIDI data reproduction buffer 24*e* (FIG. 4B) is acquired and converted into time information. The reproduction buffer is used for the MIDI data reproduction module (FIG. 11) to reproduce the MIDI data, and the address thereof corresponds to a reproduction time. Next, the latest time stamp is acquired at the read pointer. Then, the times indicated by the time stamp and read pointer are added together to obtain a reproduction time.

At Step SG5, the reproduction time is compared with the value of the clock counter. If the comparison result shows that both the reproduction time and the value of the clock counter are the same, the timing of the audio data is correct, whereas if they are different, it means that the timing of the MIDI data was shifted.

At Step SG6, in accordance with the comparison results, the delta time values in the MIDI data is adjusted as shown in FIG. 7 to compensate for the timing shift of the MIDI data. Namely, the delta time values of the data to be reproduced from the time indicated by the read pointer to the time when the scheduler is next activated, are changed. After the above operations, the first scheduler process is terminated.

As above, by periodically correcting the timing shift of audio data and MIDI data, it is possible to synchronize the audio data and MIDI data. The audio data and MIDI data can be periodically synchronized both at the server 3 and client 9.

Next, with reference to FIGS. 15 and 16, two methods of synchronizing audio data and MIDI data at the client 9 with ease will be described. These methods do not periodically synchronize the audio data and MIDI data both at the server 3 and client 9. However, since the audio data and MIDI data can be synchronized, the timing shift between the server 3 and client 9 can be solved.

Figure 15:
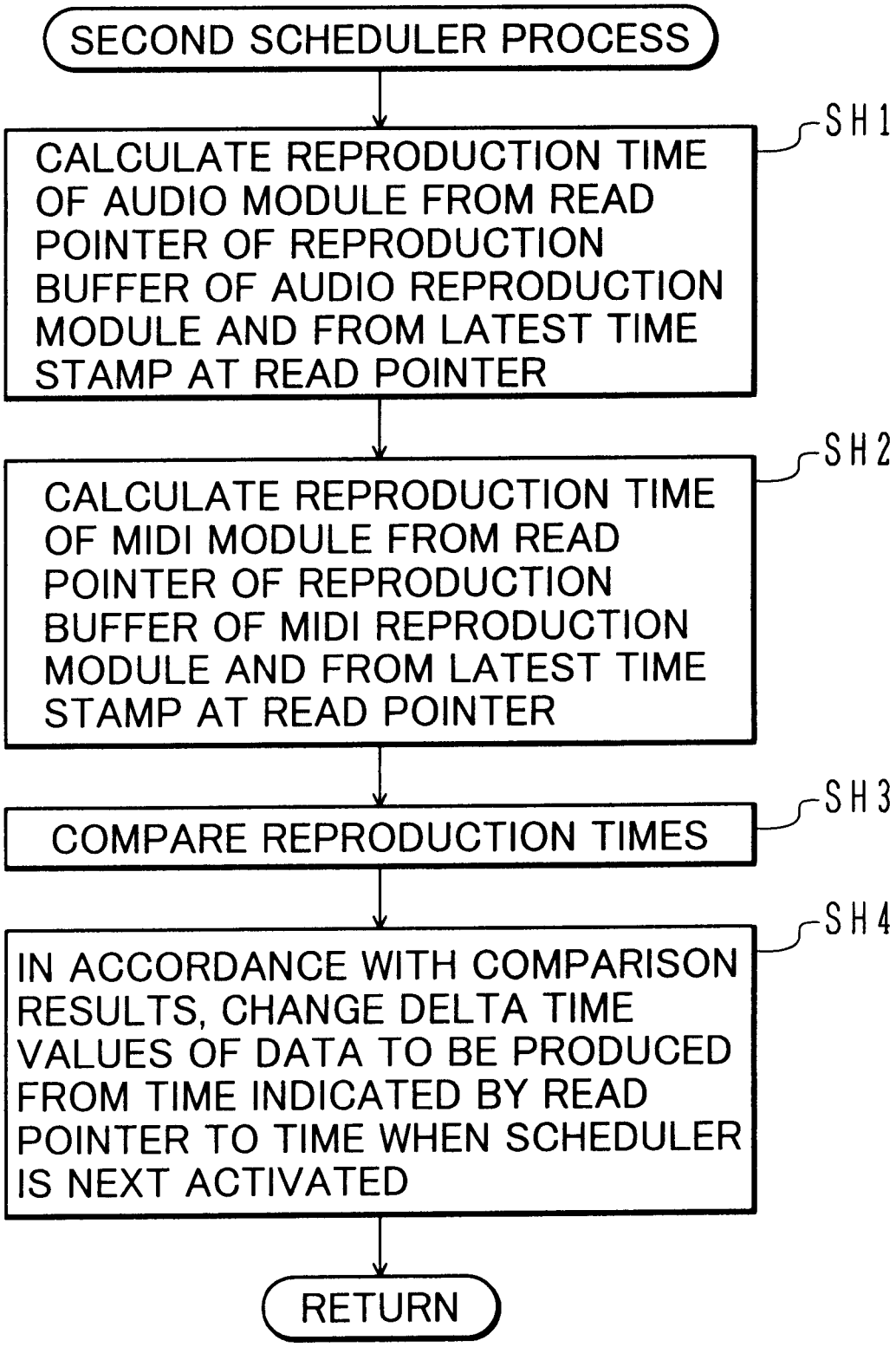
FIG. 15 is a flow chart illustrating a second scheduler process.

FIG. 15 is a flow chart illustrating a second scheduler process to be executed in place of the first scheduler process shown in FIG. 14. This process is activated periodically (e.g., at an interval of 2 seconds) by the interrupt process to synchronize MIDI data and audio data.

Similar to Step SG1 (FIG. 14), at Step SH1 a reproduction time of audio data is calculated by using the read pointer and time stamp.

Similar to Step SG4 (FIG. 14), at Step SH2 a reproduction time of MIDI data is calculated by using the read pointer and time stamp.

At Step SH3, the reproduction time of the audio data is compared with the reproduction of the MIDI data. If the comparison result shows that both the reproduction times of the audio data and MIDI data are the same, the timing of both the audio data and MIDI data is correct, whereas if they are different, it means that the timing of the audio data and MIDI data was shifted. By comparing the reproduction times, the audio data and MIDI data can be synchronized. As different from the first scheduler process shown in FIG. 14, since the clock counter value is not compared, synchronization between the server 3 and client 9 is impossible.

Similar to Step SG6 (FIG. 14), at Step SH4, in accordance with the comparison results, the delta values of the MIDI data are changed to compensate for the timing shift of the MIDI data. By periodically compensating for a timing shift of the MIDI data, the audio data and MIDI data can be synchronized. After these operations, the second scheduler process is terminated.

Figure 16:
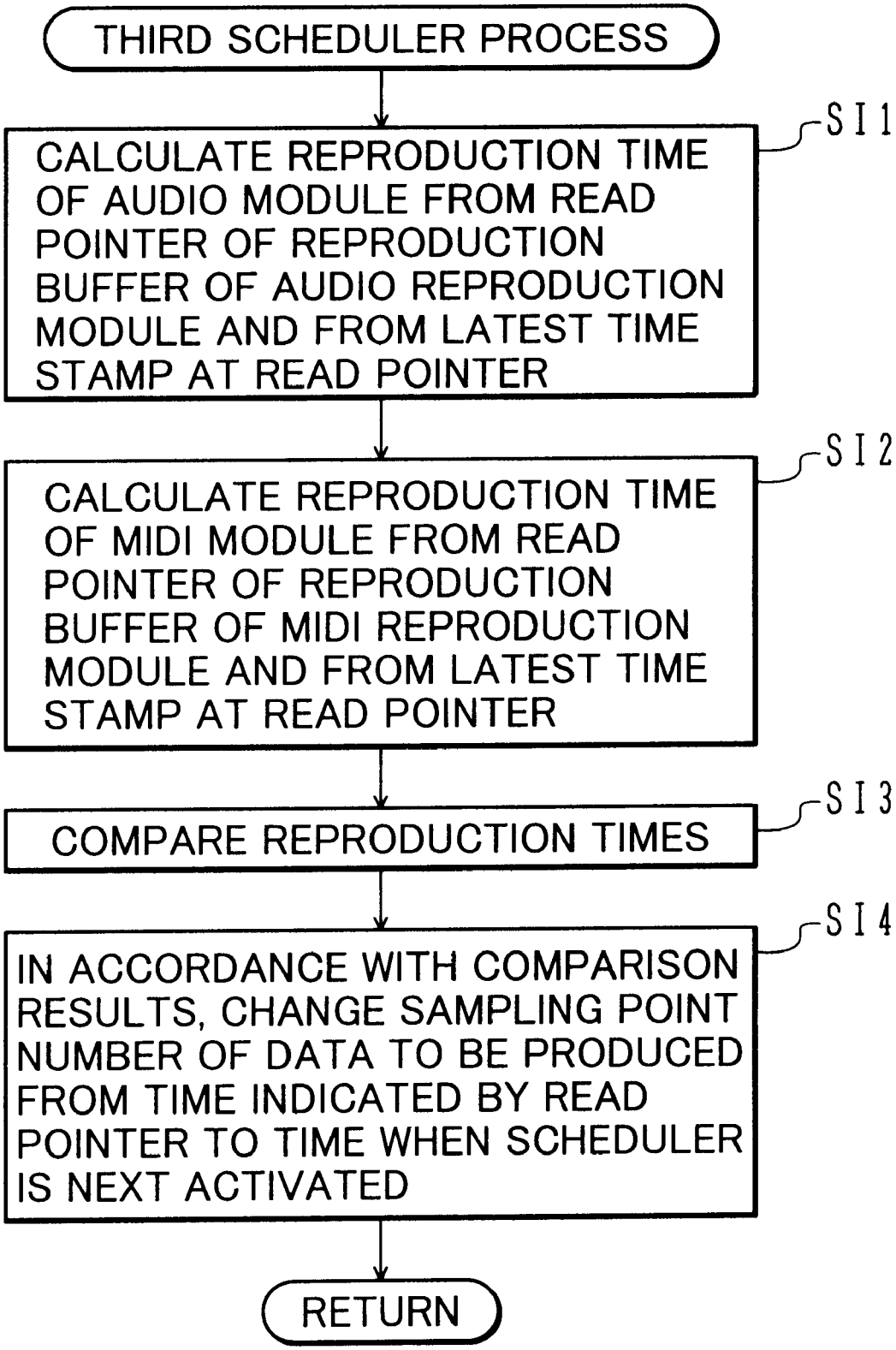
FIG. 16 is a flow chart illustrating a third scheduler process.

FIG. 16 is a flow chart illustrating a third scheduler process to be executed in place of the first scheduler process shown in FIG. 14. This process is activated periodically (e.g., at an interval of 2 seconds) by the interrupt process to synchronize MIDI data and audio data.

In the second scheduler process (FIG. 15), the timing of the MIDI data is changed to synchronize the MIDI data and audio data. In the third scheduler process (FIG. 16), the timing of the audio data is changed to synchronize the MIDI data and audio data.

Similar to Step SG1 (FIG. 14), at Step SI1 a reproduction time of audio data is calculated by using the read pointer and time stamp.

Similar to Step SG4 (FIG. 14), at Step SI2 a reproduction time of MIDI data is calculated by using the read pointer and time stamp.

At Step SI3, the reproduction time of the audio data is compared with the reproduction of the MIDI data. If the comparison result shows that both the reproduction times of the audio data and MIDI data are the same, the timing of both the audio data and MIDI data is correct, whereas if they are different, it means that the timing of the audio data and MIDI data was shifted.

Similar to Step SG3 (FIG. 14), at Step SI4, in accordance with the comparison results, the number of sampling points of the audio data is changed to compensate for the timing shift of the audio data. By periodically compensating for a timing shift of the audio data, the audio data and MIDI data can be synchronized. After these operations, the third scheduler process is terminated.

In the embodiment described above, in transmitting musical tone information of two different types (e.g., audio data and MIDI data) in the form of packet, a time stamp is added to each packet. The time stamp indicates a performance time (or record time) of the musical tone information in the packet. The musical tone information is not limited to different types, but a plurality of musical tone information pieces of the same type may also be applied.

The client 9 at a reception side receives the packet including the time stamp. In reproducing the musical tone information in the packet, the audio data and MIDI data can be synchronized by using the time stamp. Specifically, a timing shift between the audio data and MIDI data is periodically detected, and if there is any timing shift, this shift is compensated to synchronize the audio data and MIDI data.

The client 9 sets the time stamp value to the clock counter which is incremented by the interrupt process. The clock count value at the client 9 can be measured synchronously with the time stamp value. In accordance with the clock count value, the timing shift between the audio data and MIDI data is detected to synchronize the server 3 and client 9.

The embodiment is not limited only to the communications of audio data and MIDI data over the Internet. For example, other communications such as IEEE1394 digital serial communications and satellite communications may be used.

Figure 17:
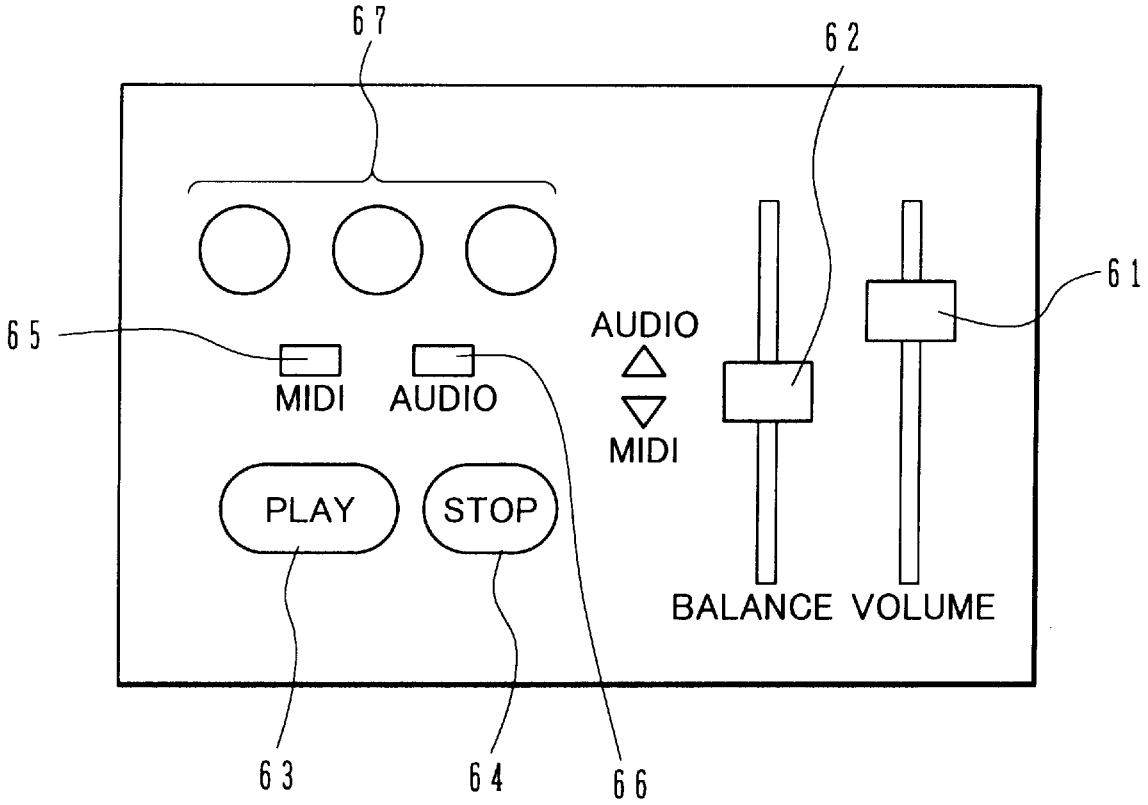

FIG. 17 shows an input screen displayed on the display device 29 (FIGS. 1 and 3) of the home computer 9. A user can enter the following information by using a mouse or keyboard of the home computer 9.

Displayed on the input screen are a volume operator 61, a balance operator 62, a play button 63, a stop button 64, a MIDI data display lamp 65, an audio data (or voice data) display lamp 66, and other operation buttons 67.

The volume operator 61 is used for setting a volumes of reproduced sounds of MIDI data and audio data. For example, the volume of reproduced sounds of MIDI data and audio data can be changed by moving the mouse cursor to the position of the volume operator and dragging the volume operator 61. As the volume operator 61 is moved upwards, the volume becomes high, and as it is moved downwards, the volume becomes low. As the volume operator 61 is moved, the display position on the input screen changes. A user can visually know the volume by looking at the position of the volume operator 61. The details of the volume operator 61 will be later described with reference to FIGS. 18A and 18B.

The balance operator 62 is used for setting the volume balance between reproduced sounds of MIDI data and audio data. For example, as the balance operator 62 is moved upwards, the reproduced sound of audio data becomes larger than that of MIDI data, and as the balance operator 62 is moved downwards, the reproduced sound of audio data becomes smaller than that of MIDI data. The details of the balance operator 62 will be later described with reference to FIG. 19.

The play button 63 is used for reproducing MIDI data and/or audio data. The stop button 64 is used for stopping the reproduction. For example, this operation can be performed by clicking the reproduction button 63 or stop button with the mouse.

The play button 63 and stop button 64 may be used so that the MIDI data and audio data can be stopped and played independently, or both the data can be stopped and played at the same time. If the MIDI data and audio data are to be stopped and played independently, the play button 63 and stop buttons 64 may be provided for each of the MIDI data and audio data.

The MIDI data display lamp 65 informs a user of the reproduction of MIDI data. The audio data display lamp 66 informs the user of the reproduction of audio data.

Figure 18A:
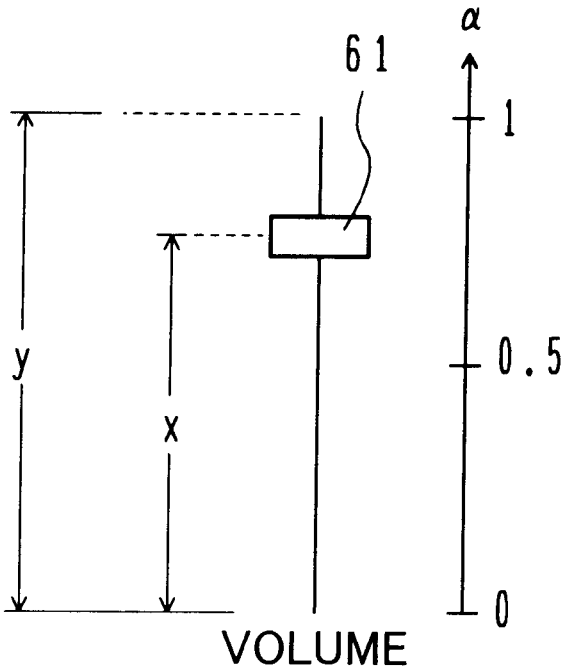
FIGS. 18A and 18B are diagrams illustrating a volume control method by the volume operator.

FIG. 18A is a diagram illustrating a first volume control by the volume operator 61. By manipulating the volume operator 61, the volume coefficient a can be changed. The volume coefficient a changes with the position of the volume operator 61. The coefficient $\alpha$ is 1 at the highest position of the volume operator 61, 0 at the lowest position, and 0.5 at the middle position.

The coefficient $\alpha$ at the position of the volume operator 61 is given by:

$$\alpha = x/y$$

where x is a distance of the operator 61 from the lowest position, and y is a distance between the highest and lowest positions.

A method of controlling the volume of MIDI data will be described. The home computer receives MIDI data from the concert hall via the Internet as described previously. The MIDI data contains a track volume (main volume). The track volume can be designated by a MIDI control change message. The first byte data of the control change message is set to "7" and the second byte data is set with a track volume value Vtr from "0" to "127".

A volume value Vtr1 of MIDI data is represented by a value of the track volume value Vtr multiplied by the volume coefficient a as in the equation (1):

$$Vtr1 = Vtr \times \alpha \quad (1)$$

Although the track volume Vtr may be set to the maximum value of "127" in advance, an intention of a player (MIDI data) cannot be reflected sufficiently. It is therefore preferable that the track volume value Vtr transmitted from a player to the home computer is adopted.

Next, a method of controlling the volume of audio data will be described. The volume value Vau1 of audio data is represented by a value of the maximum volume Vau of the voice output device 11 (FIG. 1) multiplied by the volume coefficient a as in the equation (2):

$$Vau1 = Vau \times \alpha \quad (2)$$

The MIDI data and audio data can be synchronized by the methods described earlier. The MIDI data and audio data at the same timing have the musical correlation. For example, the musical correlation is associated with a volume, effect information (of equalizer, filter and the like), and the like. Therefore, it is necessary to change the volumes of both the MIDI data and audio data by using one volume operator 61. Similar to the volume operator 61, an operator for controlling the effect information may be provided.

The volumes of MIDI data and audio data of all channels may be controlled by one volume operator 61, or two volume operators may be provided to independently control the volumes of MIDI data and audio data. Volume operators same in number as the number of MIDI channels may be provided to control each MIDI channel independently. In these cases, a different track volume Vtr can be set for each MIDI channel because the control change message contains a MIDI channel number.

If the volume operators same in number as the number of MIDI channels are displayed on the display device, the input screen may becomes confused. In such a case, the volume operators of all the MINI channels are not displayed, but only the volume operator of the MIDI channel whose MIDI data is being received (or reproduced) may be displayed. In this case, other unnecessary volume operators 61 are not displayed and the following advantages can be obtained.

Even if the volume operator 61 of some MIDI channel is operated, there is a case where the MIDI data of the MIDI channel is not present (not under reproduction). In such a case, a user is free from a confusion that even if the operator 61 is manipulated, the volume is not changed.

Next, another method of setting the volume coefficient $\alpha$ will be described.

Figure 18B:
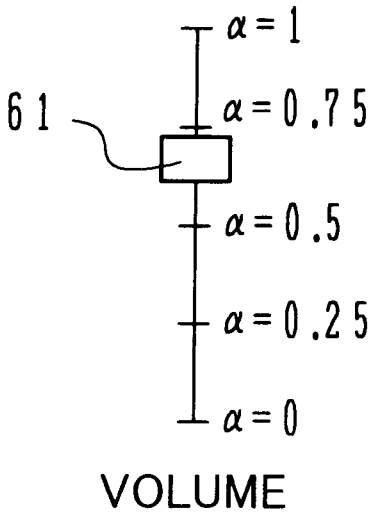

FIG. 18B is a diagram illustrating the second volume control by the volume operator 61.

The whole motion span of the volume operator 61 is divided into, for example, four areas by setting five points. The five points are assigned volume coefficients 0, 0.25, 0.5, 0.75, and 1. The point nearest to the volume operator 61 is detected from the five points, and the coefficient $\alpha$ corresponding to the detected point is selected and set. In the example shown in FIG. 18B, the coefficient $\alpha$ nearest to the volume operator 61 is 0.75 so that this coefficient $\alpha$=0.75 is set.

An example of the method of detecting a point nearest to the volume operator 61 will be described. First, distances of the volume pointer 61 to the five points are calculated to identify the point having the shortest distance among the five distances. The coefficient a corresponding to this identified point is set.

The five coefficients a corresponding to the five points may be stored in a table so that the coefficient α can be made variable. After the point nearest to the volume operator 61 is detected by the above method, the coefficient α corresponding to the point is read from the table and set.

By storing the coefficients α in the table, a relation between the volume operator position and coefficient α can be easily determined, even if the relation is difficult to be determined through calculations. For example, by using the table, various curves representing the relation between the volume operator position and coefficient α can be used.

Figure 19:
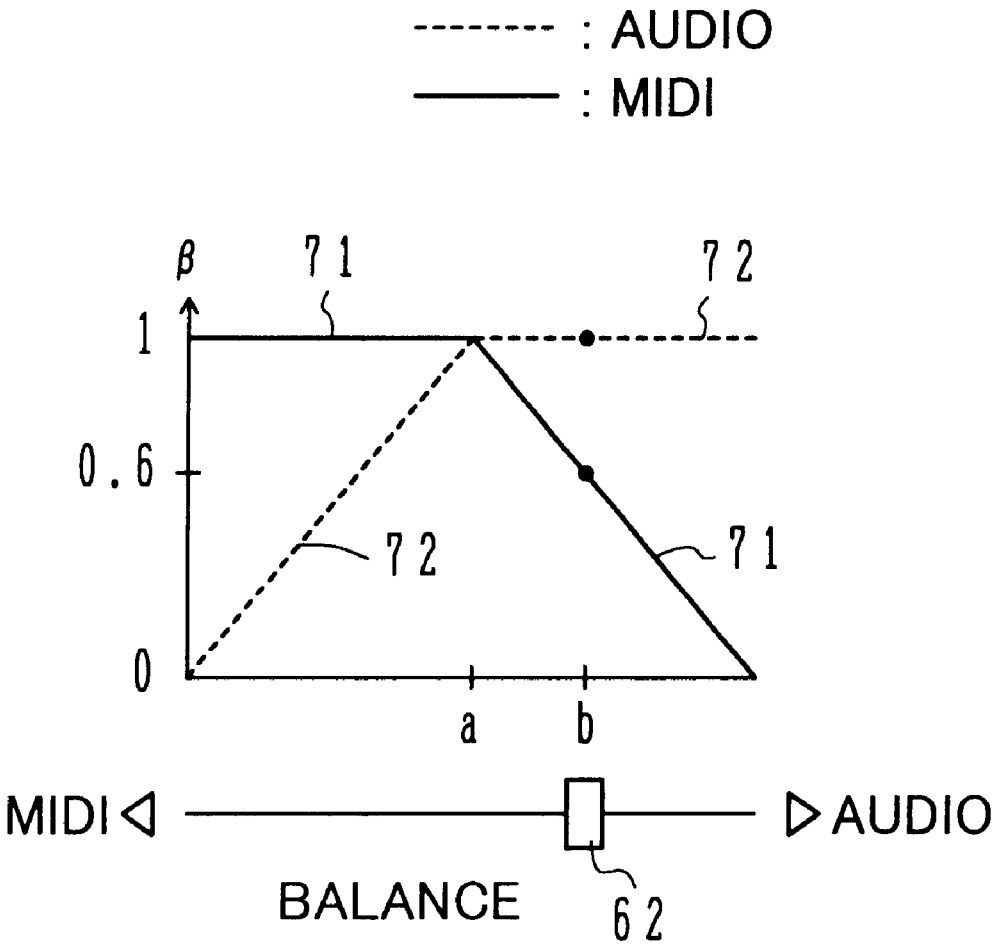
FIG. 19 is a graph illustrating a volume balance control method by the balance operator.

FIG. 19 is a graph illustrating the volume balance control by the balance operator 62. Although the balance operator 62 moves up and down in FIG. 17, the balance operator 62 is shown movable in the horizontal direction in FIG. 19 for the convenience of description. The abscissa represents the position the balance operator 62, and the ordinate represents a volume coefficient β.

A MIDI data characteristic polygonal line 71 indicated by a solid line shows a relation between the position of the balance operator 62 and a MIDI data balance coefficient β. An audio data characteristic polygonal line 72 indicated by a broken line shows a relation between the position of the balance operator 62 and an audio data balance coefficient β. The balance coefficient β is proportional to a balance between sound volumes of MIDI data and audio data.

As the balance operator 62 is set at the middle position a in a movable range, both the MIDI and audio data balance coefficients β are set to "1" and the sound volumes of both the MIDI and audio data are balanced.

As the balance operator 62 is moved to the left from the middle position a, the audio data balance coefficient β becomes small and the MIDI data balance coefficient β remains unchanged at β=1, so that the MIDI data volume becomes large relative to the audio data volume.

Conversely, as the balance operator 62 is moved to the right from the middle position a, the MIDI data balance coefficient β becomes small and the audio data balance coefficient remains unchanged at β=1, so that the audio data volume becomes large relative to the MIDI data volume.

For example, if the balance operator 62 is set to the position b, the audio data balance coefficient β is "1" and the MIDI data balance coefficient β is "0.6".

Next, a method of controlling a volume balance of MIDI data will be described. A volume value Vtr2 of MIDI data is represented by a value of the track volume value Vtr1 of the equation (1) multiplied by the balance coefficient α as in the equation (3):

$$Vtr2=Vtr1\times\beta=Vtr\times\alpha\times\beta \quad (3)$$

Next, a method of controlling a volume balance of audio data will be described. A volume value Vau2 of audio data is represented by a value of the volume value Vau1 of the equation (2) multiplied by the balance coefficient β as in the equation (4):

$$Vau2=Vau1\times\beta=Vau\times\alpha\times\beta \quad (4)$$

MIDI data and audio data are generated by different methods, and a volume balance therebetween may be lost. Since the balance therebetween can be changed by using the balance operator 62, a user can listen to MIDI data and audio data reproduced at the same time with a volume balance the user likes.

Similar to the volume coefficient α the balance coefficient β may be set either by the method illustrated in FIG. 18A or by the method illustrated in FIG. 18B.

Figure 20:
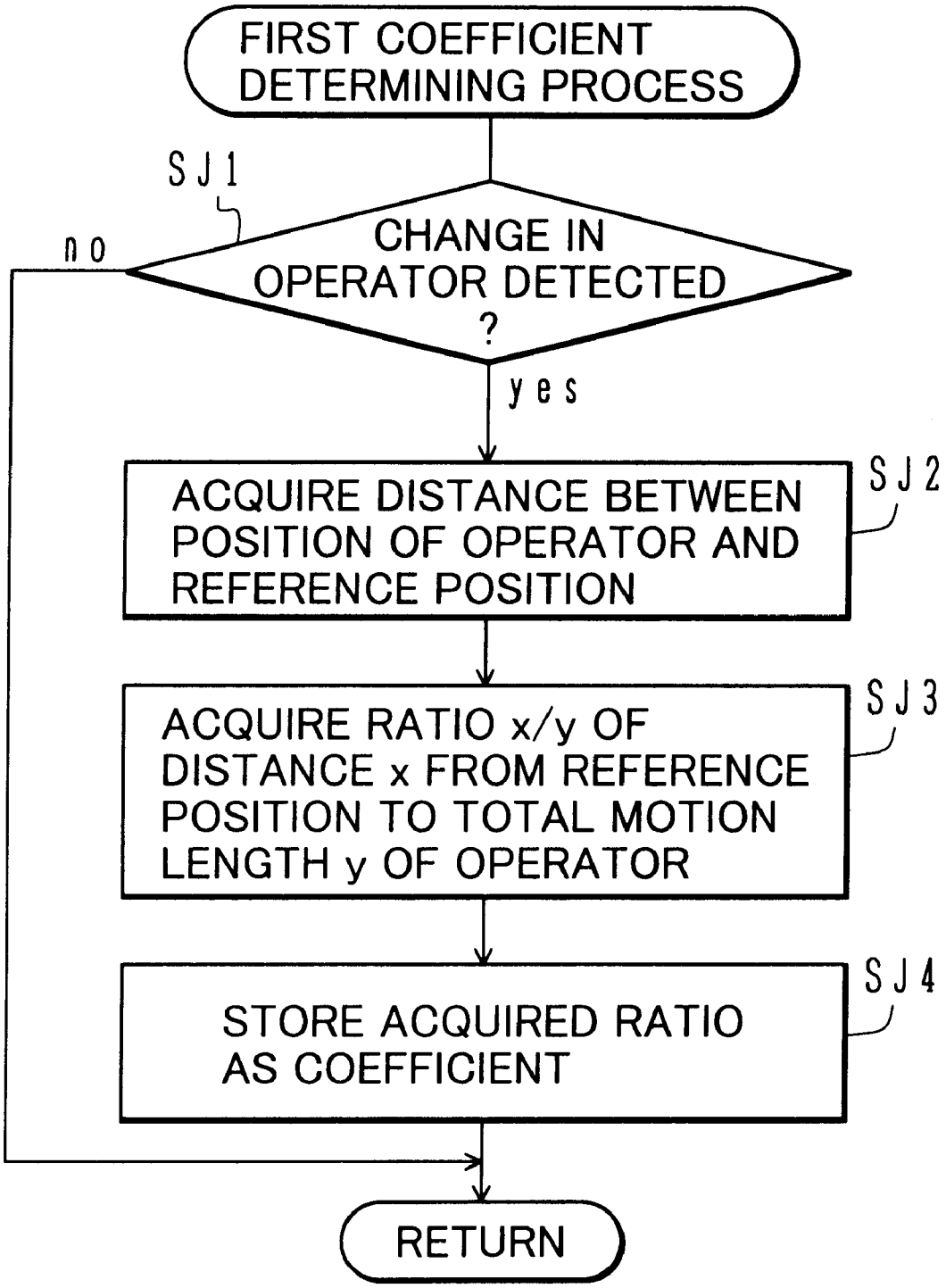
FIG. 20 is a flow chart illustrating a first method of determining a volume coefficient.

FIG. 20 is a flow chart illustrating a first coefficient determining process for the coefficient α or β. This process corresponds to the method illustrated in FIG. 18A.

At Step SJ1 it is checked whether a change in the volume operator 61 or balance operator 62 is detected. If detected, the flow advances to Step SJ2, whereas if not, the process is terminated without performing any operation.

At Step SJ2, a distance x from the position of the volume operator 61 or balance operator 62 to a reference position (e.g., the lowest position) is acquired.

At Step SJ3, a ratio x/y is acquired where y is the total motion length of the volume operator 61 or balance operator 62.

At Step SJ4, the acquired ratio x/y is set as the volume coefficient α and stored in a memory (e.g., RAM 24 in FIG. 3), or the balance coefficients β of MIDI data and audio data are set based upon the acquired ratio x/y and stored in the memory. With the above operations, the first coefficient determining process is terminated.

Figure 21:
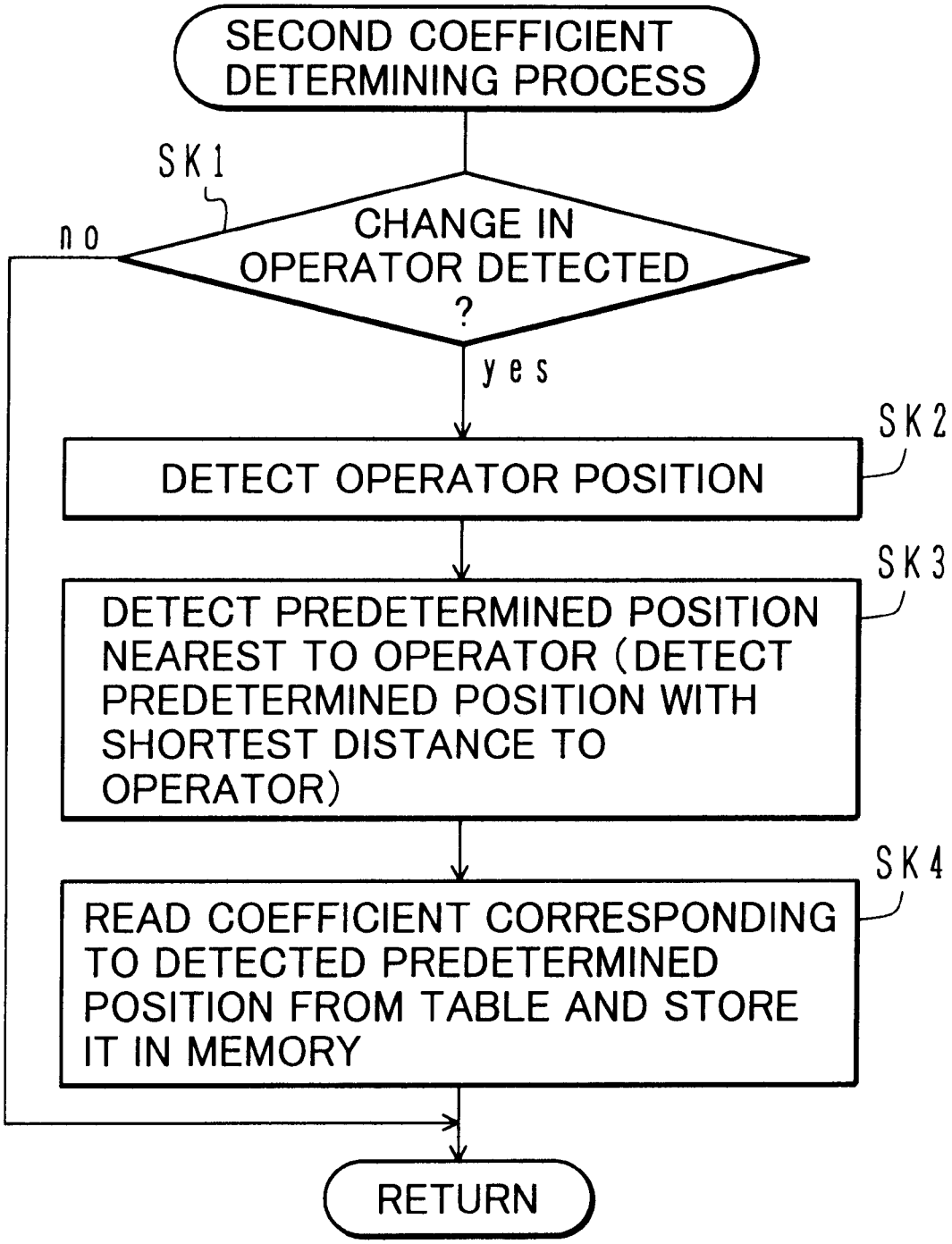
FIG. 21 is a flow chart illustrating a second method of determining a volume coefficient.

FIG. 21 is a flow chart illustrating a second coefficient determining process for the coefficient α or β. This process corresponds to the method illustrated in FIG. 18B.

At Step SK1 it is checked whether a change in the volume operator 61 or balance operator 62 is detected. If detected, the flow advances to Step SK2, whereas if not, the process is terminated without performing any operation.

At Step SJK2, a position of the volume operator 61 or balance operator 62 is detected.

At Step SK3, a predetermined position nearest to the volume operator 61 or balance operator 62 is selected from predetermined positions (e.g., five points). Namely, a predetermined position having the shortest distance to the volume operator 61 or balance operator 62 is detected.

At Step SK4, the coefficient α or β corresponding to the detected predetermined position is read from the table and stored in the memory. With the above operations, the second coefficient determining process is terminated.

Figure 22:
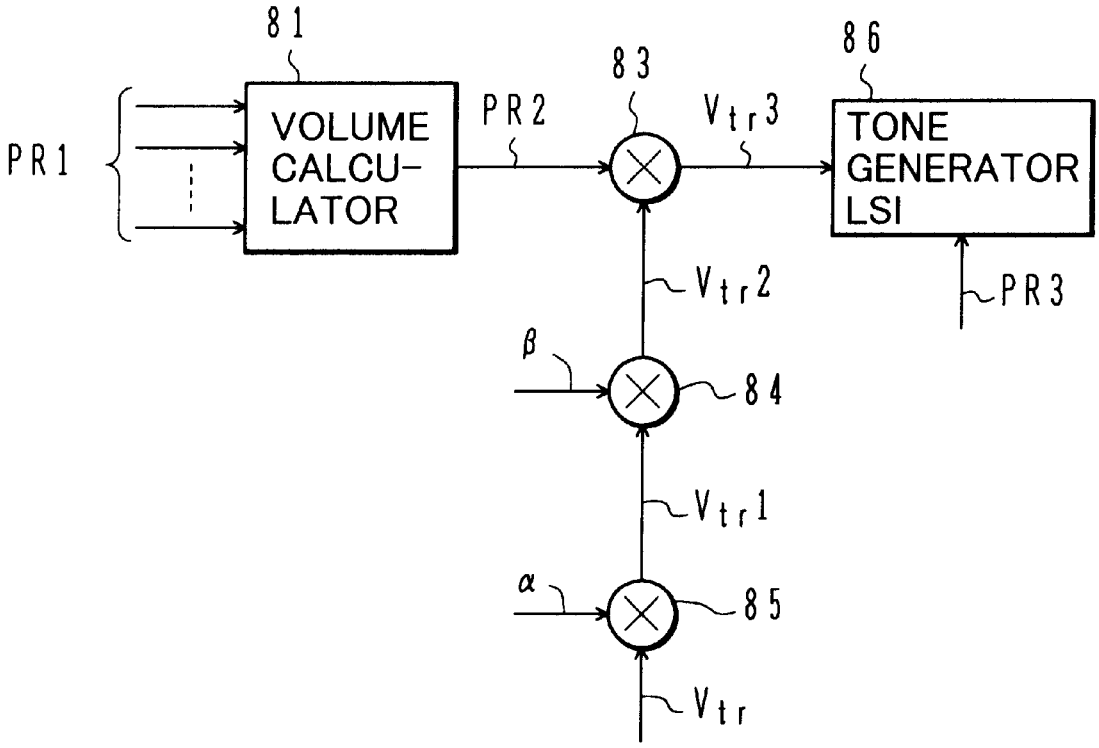
FIG. 22 is a functional block diagram illustrating a MIDI data volume control process.

FIG. 22 is a functional block diagram of the home computer 9 (FIG. 1) for performing a volume control of MIDI data.

As described previously, the track volume value Vtr is contained in a received control change message. A multiplier 85 generates a track volume value Vtr1 by multiplying the track volume value Vtr by the volume coefficient a as in the following equation:

$$Vtr1=Vtr\times\alpha$$

A multiplier 84 generates a track volume value Vtr2 by multiplying the track volume value Vtr1 by the balance coefficient β as in the following equation:

$$Vtr2=Vtr1\times\beta$$

Volume parameters PR1 are other volume parameters different from the track volume, and are a velocity, expression and the like for example. The volume parameters PR1 are input to a volume calculator 81. The volume calculator 81 calculates a parameter PR2 from the input volume parameters PR1.

A multiplier 83 multiplies the track volume value Vtr2 by the parameter to obtain a track volume value Vtr3 as in the following equation:

$$Vtr3=Vtr2\times PR2$$

A tone generator LSI 86 is supplied with the track volume Vtr3 and a parameter PR3. The parameter PR3 is different from the volume parameters Vtr and PR1, and is tone pitch information, tone color information or the like. The tone generator LSI 86 controls the volume of a musical tone signal in accordance with the track volume Vtr3, and controls the tone pitch, tone color or the like of a musical tone signal in accordance with the parameter PR3.

The tone generator LSI 86 can control each MIDI channel. The volumes of all the channel may be controlled collectively, or the volume of each channel may be controlled independently.

The tone generator LSI 86 may be replaced by another tone generator. Not only a tone generator made of custom hardware, but also a tone generator made of a digital signal processor (DSP) and microprograms and a tone generator (software tone generator) made of a CPU and software programs may be used.

Figure 23:
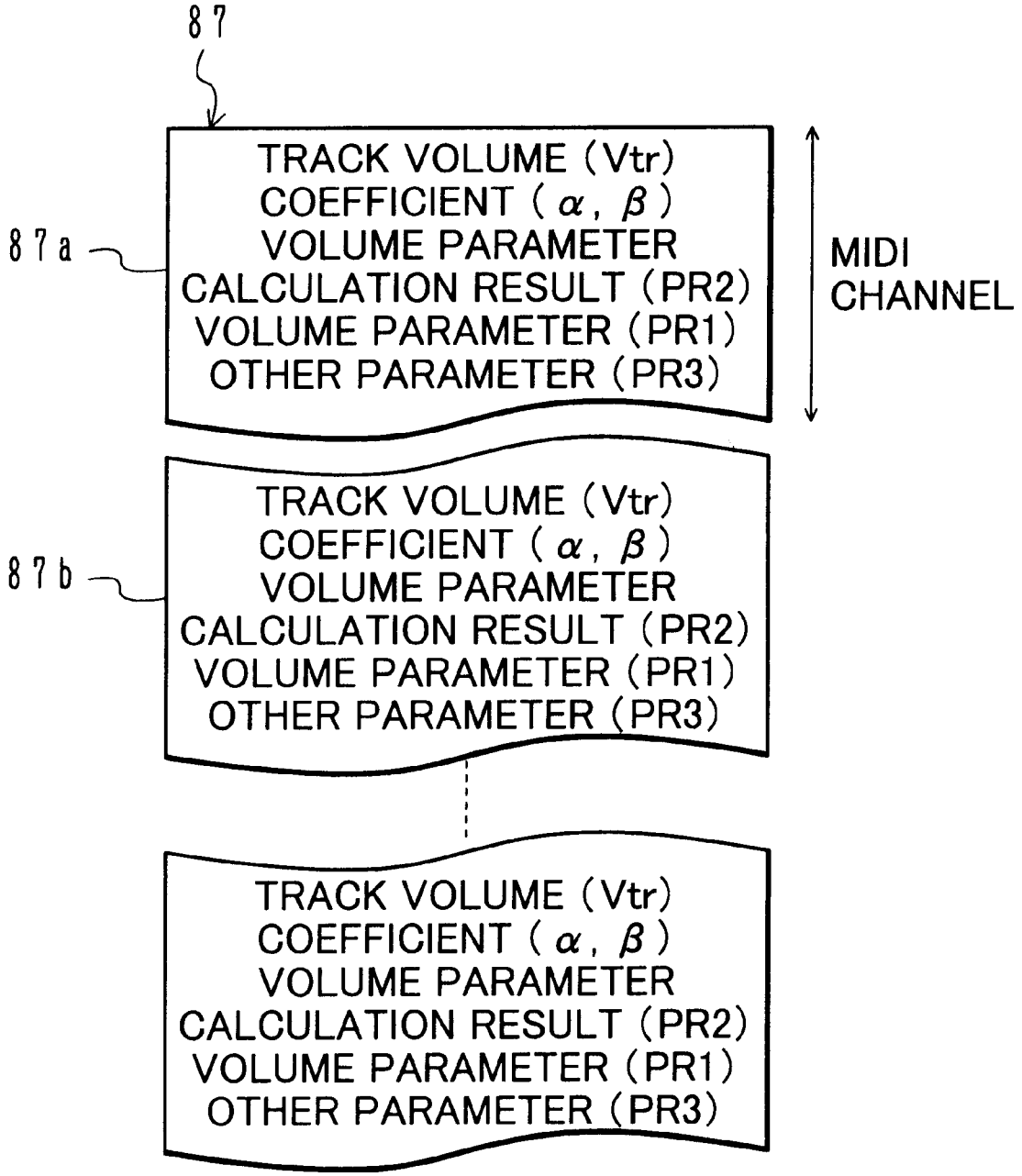
FIG. 23 is a diagram showing parameters stored for each MIDI channel.

FIG. 23 shows parameters stored in RAM 24 (FIG. 3) of the home computer.

Parameters 87 of the same types are provided for each MIDI channel (tone generator part), such as first channel parameters 87*a* and second channel parameters 87*b*, . . .

The parameters of each channel includes a track volume Vtr, volume coefficient a balance coefficient β, volume parameter calculation results PR2, volume parameter PR1, and parameter PR3.

If the volumes and balances of all MIDI channels are controlled by one volume operator 61 and by one balance operator 62, the same volume coefficient α and balance coefficient β are used for all the channels. If the operator 61 and/or 62 is provided for each MIDI channel, different coefficient α and/or β can be set to each MIDI channel.

Figure 24:
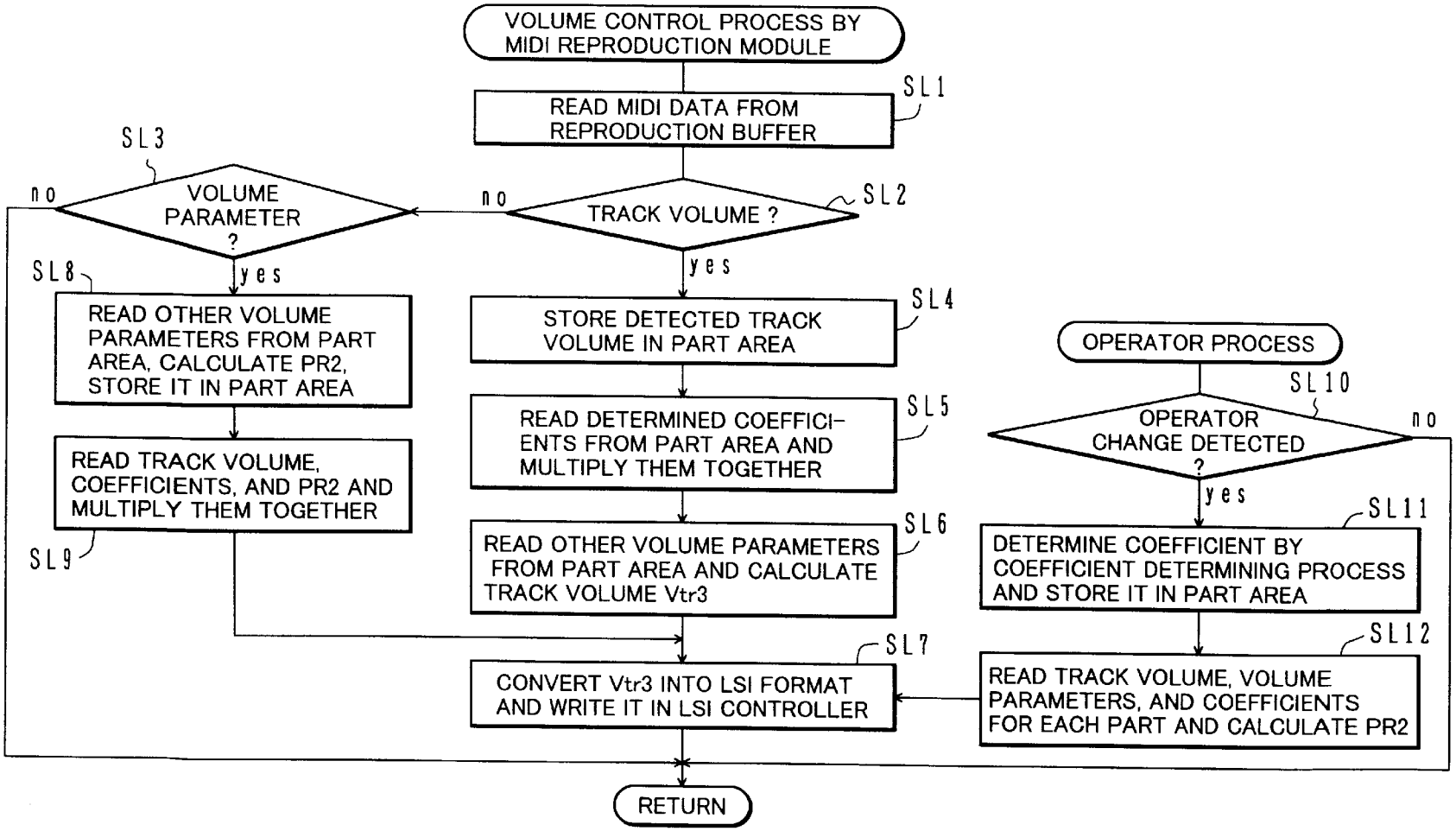
FIG. 24 is a flow chart illustrating a MIDI data volume control process.

FIG. 24 is a flow chart illustrating the volume control process for MIDI data, this process being executed by the home computer 9 (FIG. 1).

The volume control process is performed when one of the following two events occurs. The first event occurs when MIDI data is received from a concert hall (FIG. 1) which event starts from Step SL1. The second event occurs when the volume operator 61 or balance operator 62 is moved which event starts from Step SL10.

First, the volume control to be executed when MIDI data is received will be described.

At Step SL1, MIDI data is read from the reproduction buffer.

At Step SL2 it is checked whether the received MIDI data ia a track volume (control change message). If the track volume is received, the flow follows a yes arrow to advance to Step SL4, whereas if not, the flow follows a no arrow to advance to Step SL3.

At Step SL4, the detected track volume Vtr is stored in an area 87 (FIG. 23) of the corresponding MIDI channel (tone generator part).

At Step SL5, the coefficients α and β are determined from the positions of the volume operator 61 and balance operator 62, and the determined coefficients α and β are read from the part area 87. The new track volume Vtr2 is calculated by multiplying the track volume Vtr by the coefficients α and β as in the following equation:

$$Vtr2=Vtr\times\alpha\times\beta$$

At Step SL6, the other volume parameter PR1 is read from the part area 87 and the parameter PR2 is calculated from the parameter PR1. Next, the track volume Vtr3 is calculated by multiplying the track volume Vtr2 by the parameter PR2 as in the following equation:

$$Vtr3=Vtr2\times PR2$$

At Step SL7, the track volume Vtr3 is converted into a format matching the tone generator LSI 86 (FIG. 22) and written in a controller of the tone generator LSI 86. The tone generator LSI 86 controls the volume in accordance with the track volume Vtr3. With the above operations, the volume control to be executed when MIDI data is received is terminated.

At Step SL3 it is checked whether the received MIDI data is the volume parameter PR1. If the volume parameter PR1 is received, the flow follows a yes arrow to advance to Step SL8, whereas if not, the flow follows a no arrow to terminate the process without performing the volume control process.

At Step SL8, the volume parameter PR1 is read from the part area 87. Namely, if there are a plurality of volume parameters PR1 and only one parameter PR1 is received, the other parameters PR1 are read from the part area 87.

Next, the parameter PR2 is calculated from all the volume parameters PR1, and stored in the area 87.

At Step SL9, the track volume Vtr, volume coefficient α, balance coefficient β, calculated parameter PR2 are read from the part area 87 and the track volume Vtr3 is calculated through multiplication as in the following equation:

$$Vtr3=Vtr\times\alpha\times\beta\times PR2$$

Thereafter, at Step SL7, the track volume Vtr3 is converted into the format matching the tone generator LSI 86 and written in the controller thereof to terminate the process.

Next, the volume control to be executed when a user moves the volume operator 61 or balance operator 62 will be described. This process starts from Step SL10.

At Step SL10 it is checked whether a change in the volume operator 61 or balance operator 62 is detected. If detected, the flow advances to Step SL11, whereas if not, the process is terminated without performing the volume control process.

At Step SL11, the volume coefficient α or balance coefficient β is determined by the coefficient determining process (FIG. 20 or 21) and stored in the part area 87.

At Step SL12, the volume parameter PR1 is read for each part and the parameter PR2 is calculated for each part, if the volume control is performed for each part. If the volume control is performed collectively for all parts, the parameter PR2 common for all parts is calculated.

Next, the track volume Vtr, volume coefficient α and balance coefficient β are read from the part area 87, and the track volume Vtr3 is calculated as in the following equation:

$$Vtr3=Vtr\times\alpha\times\beta\times PR2$$

Thereafter, at Step SL7, the track volume Vtr3 is converted into the format matching the tone generator LSI 86 and written in the controller thereof to terminate the process.

Figure 25:
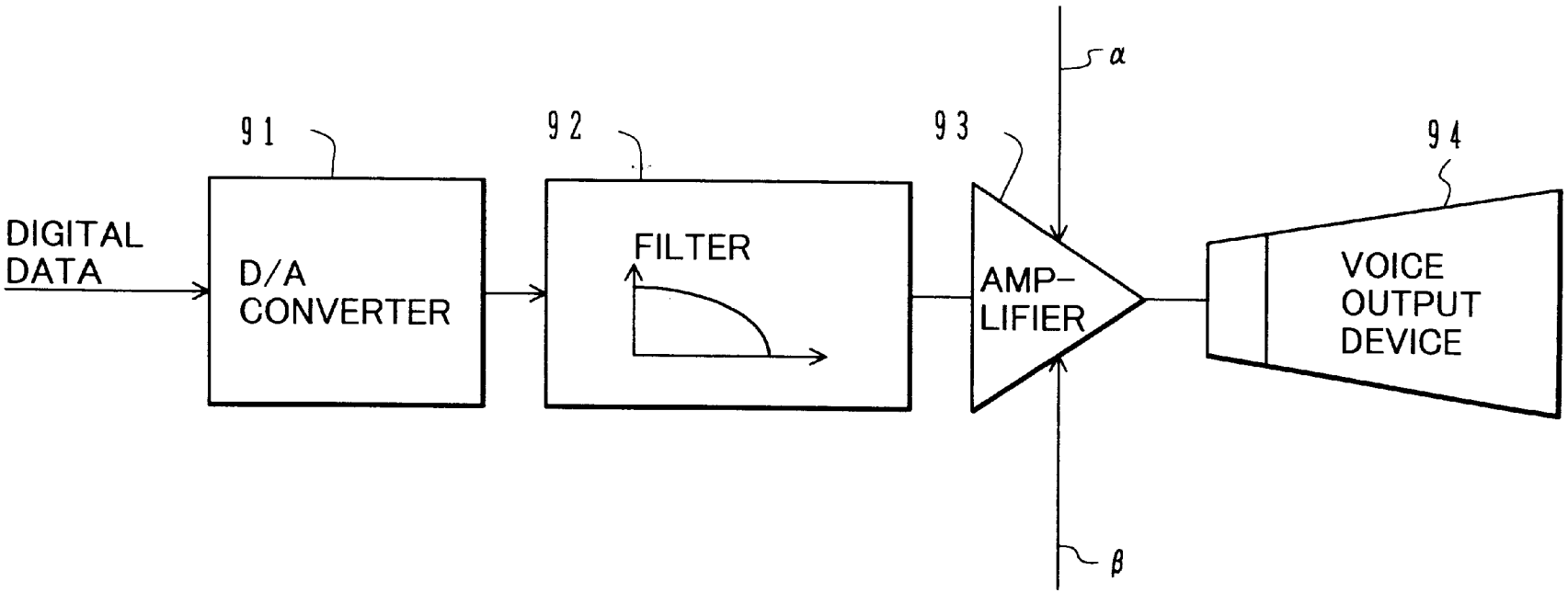
FIG. 25 is a functional block diagram illustrating audio data (voice data) volume control.

FIG. 25 is a functional block diagram illustrating the volume control process for audio data, the process being executed by the home computer 9 (FIG. 1).

A D/A converter 91 is supplied with digital audio data received from the concert hall 1 (FIG. 1). The D/A converter 91 converts the digital audio data into analog audio data. A filter 92, e.g., a low-pass filter, cuts a predetermined frequency range of the analog audio data.

An amplifier 93 performs the volume control for the filtered audio data, in accordance with the volume coefficient $\alpha$ and balance coefficient $\beta$. The amplifier 93 amplifiers the audio data to the volume Vau2 as in the following equation:

$$Vau2=Vau\times\alpha\times\beta$$

where Vau is the maximum volume of the amplifier 93.

The D/A converter 91, filter 92, and amplifier 93 may be replaced by the codec circuit 27*b* (FIG. 3). The volume control by the amplifier 93 can be performed in a digital manner by simply designating parameters of the amplifier 93.

If the Windows is used as an operating system (OS) of the home computer, the volume can be set by using a windows control panel. In this case, the volume control by the amplifier 93 can be replaced by a process similar to the volume control by the control panel.

A voice output device 94 is a speaker for example, and reproduces the volume controlled audio data.

Figure 26:
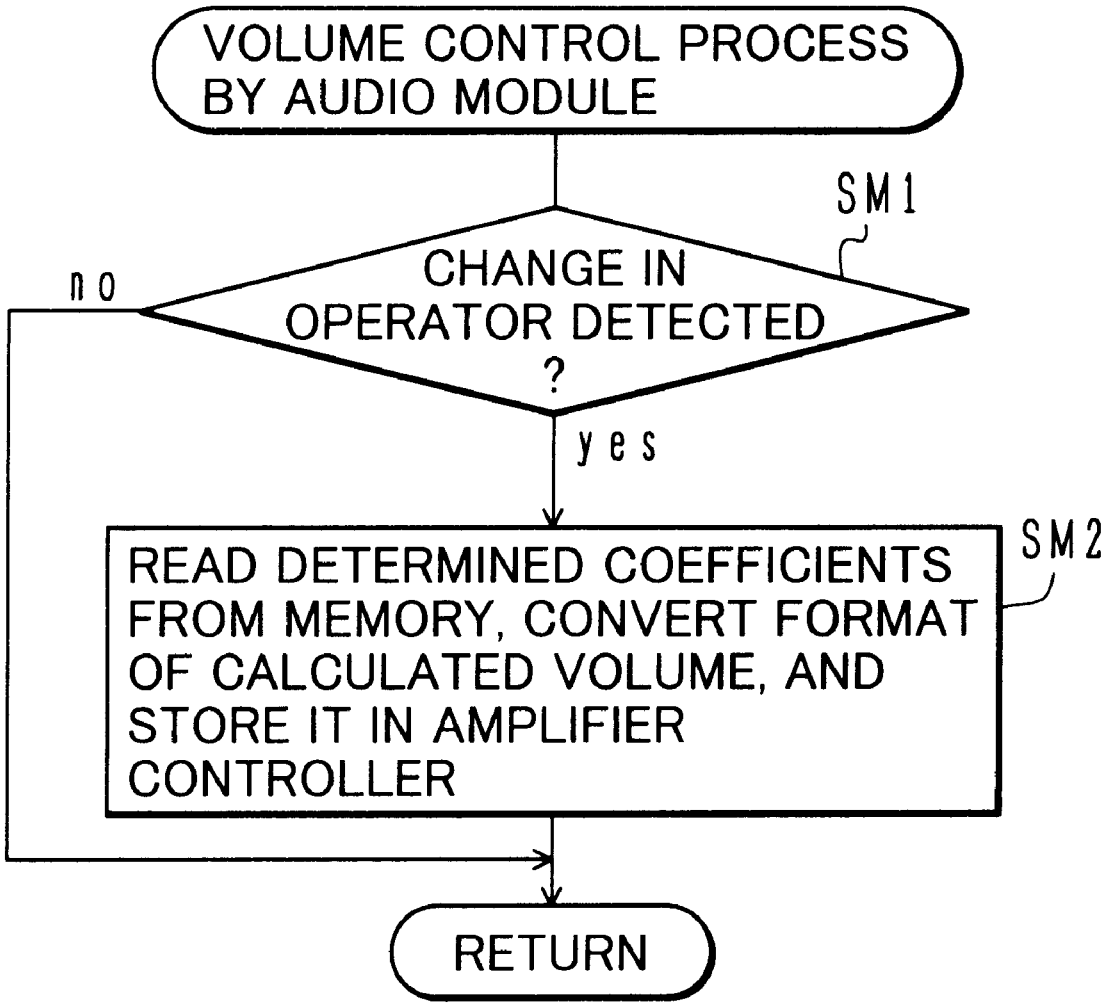
FIG. 26 is a flow chart illustrating an audio data (voice data) volume control process.

FIG. 26 is a flow chart illustrating the volume control process for audio data.

At Step SM1 it is checked whether a change in the volume operator 61 or balance operator 62 is detected. If detected, the flow advances to Step SM2, whereas if not, the process is terminated without performing the volume control process.

At Step SM2, the volume coefficient $\alpha$ or balance coefficient $\beta$ is determined by the coefficient determining process (FIG. 20 or 21) and stored in a memory (e.g., RAM 24 in FIG. 3).

Next, the coefficients $\alpha$ and $\beta$ are read from the memory and the volume Vau2 ($=Vau\times\alpha\times\beta$) is calculated by using the equation (4). The calculated volume Vau is converted into a format matching the amplifier 93 (FIG. 25) and written in the controller of the amplifier 93. The amplifier 93 performs the volume control in accordance with the coefficients $\alpha$ and $\beta$ to reproduce the audio data from a voice output device 94. With the above operations, the volume control process is terminated.

A user can control the volumes of MIDI data and/or audio data by manipulating the volume operator 61. If the position of the volume operator 61 is displayed, the user can visually confirm the volume.

A user can also control the volume balance between MIDI data and audio data by manipulating the balance operator 62. In this case, it is preferable to balance the volumes by fixing the volume of one of the MIDI data and audio data and lowering the volume of the other. With this method, a user can easily perceive auditorily a change in the balance and the balance adjustment becomes easy.

In addition to the volume operator 61 and balance operator 62 used for the volume and balance controls, other operators may also be provided for controlling other musical tone parameters. In this case, by using other musical tone parameters as control parameters, the other musical tone parameters can be controlled similar to the volume and balance. Such other musical tone parameters are effect parameters (equalizer, filter, and the like) and the like.

The present invention has been described in connection with the preferred embodiments. The invention is not limited only to the above embodiments. It is apparent that various modifications, improvements, combinations, and the like can be made by those skilled in the art.

What is claimed is:

1. A communications apparatus for musical tone information comprising:

means for adding time information on a common time axis to each of first and second musical tone information; and transmitting means for transmitting each of the first and second musical tone information added with the time information associated with each of the first and second musical tone information.

2. A communications apparatus for musical tone information according to claim 1, wherein the first and second musical tone information is generated by different musical tone information generators.

3. A communications apparatus for musical tone information according to claim 1, wherein the first musical tone information is MIDI data information, and the second musical tone information is audio data information.

4. A communications apparatus for musical tone information according to claim 1, wherein said adding means divides each of the first and second musical tone information into musical tone packets, adds the time information to each musical tone packet, and generates transmission packets, and said transmitting means transmits the transmission packet.

5. A communications apparatus for musical tone information according to claim 4, said transmitting means transmits the transmission packet over the Internet.

6. A communications apparatus for musical tone information according to claim 3, further comprising input means for inputting MIDI data generated in real time in accordance with a performance made by a player, and audio data converted from voices or sounds in real time into electrical signals, wherein said transmitting means transmits the input MIDI data and audio data in real time.

7. A communications apparatus for musical tone information according to claim 1, further comprising:

receiving means for receiving each of the first and second musical tone information and the time information associated with each of the first and second musical tone information, transmitted by said transmitting means; and output means for synchronizing the first and second musical tone information in accordance with the time information and outputting the synchronized first and second musical tone information to a reproduction apparatus.

8. A communications apparatus for musical tone information according to claim 7, wherein said output means outputs in real time the received first and second musical tone information to the reproduction apparatus.

9. A communications apparatus for musical tone information according to claim 7, said output means includes means for periodically synchronizing the first and second musical tone information.

10. A communications apparatus for musical tone information according to claim 9, wherein said synchronizing means includes correcting means for periodically detecting a presence/absence of a timing shift between the first and second musical tone information, and when the timing shift is detected, correcting the timing shift.

11. A communications apparatus for musical tone information according to claim 10, wherein the first or second musical tone information is audio data, and said correcting means corrects the timing shift by compressing or interpolating the audio data.

12. A communications apparatus for musical tone information according to claim 10, wherein the first or second musical tone information includes a plurality of MIDI events and time interval information representing an interval between the plurality of MIDI events, and said correcting means corrects the timing shift by adjusting the time interval information.

13. A communications apparatus for musical tone information comprising:

receiving means for receiving first and second musical tone information and time information associated with each of the first and second musical tone information, wherein the time information was added on a common time axis to each of the first and second musical tone inform; and output means for synchronizing the first and second musical tone information in accordance with the time information and outputting the synchronized first and second musical tone information to a reproduction apparatus.

14. A communications apparatus for musical tone information according to claim 13, wherein the first and second musical tone information is generated by different musical tone information generators.

15. A communications apparatus for musical tone information according to claim 13, wherein the first musical tone information is MIDI data information, and the second musical tone information is audio data information.

16. A communications apparatus for musical tone information according to claim 13, wherein said receiving means receives a transmission packet which is a musical tone packet added with the time information, the musical tone packet being obtained by dividing each of the first and second musical tone information.

17. A communications apparatus for musical tone information according to claim 13, wherein said receiving means receives the transmission packet over the Internet.

18. A communications apparatus for musical tone information according to claim 13, wherein said output means outputs in real time the received first and second musical tone information to the reproduction apparatus.

19. A communications apparatus for musical tone information according to claim 13, said output means includes means for periodically synchronizing the first and second musical tone information.

20. A communications apparatus for musical tone information according to claim 19, wherein said synchronizing means includes correcting means for periodically detecting a presence/absence of a timing shift between the first and second musical tone information, and when the timing shift is detected, correcting the timing shift.

21. A communications apparatus for musical tone information according to claim 20, wherein the first or second musical tone information is audio data, and said correcting means corrects the timing shift by compressing or interpolating the audio data.

22. A communications apparatus for musical tone information according to claim 20, wherein the first or second musical tone information includes a plurality of MIDI events and time interval information representing an interval between the plurality of MIDI events, and said correcting means corrects the timing shift by adjusting the time interval information.

23. A communications apparatus for musical tone information comprising:

an adder for adding time information on a common time axis to each of first and second musical tone information; and a transmitter for transmitting each of the first and second musical tone information added with the time information associated with each of the first and second musical tone information.

24. A communications apparatus for musical tone information comprising:

a receiver for receiving first and second musical tone information and time information associated with each of the first and second musical tone information, wherein the time information was added on a common time axis to each of the first and second musical tone information; and an output unit for synchronizing the first and second musical tone information in accordance with the time information and outputting the synchronized first and second musical tone information to a reproduction apparatus.

25. A communications method for musical tone information comprising the steps of:

(a) adding time information on a common time axis to each of first and second musical tone information; and (b) transmitting each of the first and second musical tone information added with the time information associated with each of the first and second musical tone information.

26. A communications method for musical tone information comprising the steps of:

(a) adding time information on a common time axis to first and second musical tone information;

(b) receiving the first and second musical tone information and the time information associated with each of the first and second musical tone information; and (c) synchronizing the first and second musical tone information in accordance with the time information and outputting the synchronized first and second musical tone information to a reproduction apparatus.

27. A computer readable recording medium storing a program realizing a communications method for musical tone information comprising the steps of:

(a) adding time information on a common time axis to each of first and second musical tone information; and (b) transmitting each of the first and second musical tone information added with the time information associated with each of the first and second musical tone information.

28. A computer readable recording medium storing a program realizing a communications method for musical tone information comprising the steps of:

(a) adding time information on a common time axis to first and second musical tone information;

(b) receiving the first and second musical tone information and the time information associated with each of the first and second musical tone information; and (c) synchronizing the first and second musical tone information in accordance with the time information and outputting the synchronized first and second musical tone information to a reproduction apparatus.

29. A musical tone information control apparatus, comprising:

means for receiving MIDI data and audio data, in streams, along with time information associated with each of the MIDI data and audio data, wherein the time information was added on a common time axis to each of the MIDI data and audio data to synchronize the MIDI data and audio data;

means for designating a musical tone parameter;

control means for controlling MIDI data and audio data received in streams in accordance with the musical tone parameter designated by said designating means; and reproduction designating means for designating a reproduction of the MIDI data and audio data controlled by said control means.

30. A musical tone information control apparatus according to claim 29, wherein said control means controls both the MIDI data and audio data in accordance with one musical tone parameter designated by said designating means.

31. A musical tone information control apparatus according to claim 29, wherein said designating means independently designates a musical tone parameter of the MIDI data and a musical tone parameter of the audio data, and said control means independently controls the MIDI data and the audio data in accordance with the musical tone parameters of the MIDI data and the audio data designated by said designating means.

32. A musical tone information control apparatus according to claim 29, further comprising display means for displaying the musical tone parameter designated by said designating means.

33. A musical tone information control apparatus, comprising:

a receiver for receiving MIDI data and audio data, in streams, along with time information associated with each of the MIDI data and audio data, wherein the time information was added on a common time axis to each of the MIDI data and audio data to synchronize the MIDI data and audio data;

a designator for designating a musical tone parameter;

a controller for controlling MIDI data and audio data received in streams in accordance with the musical tone parameter designated by said designating means; and a reproduction designator for designating a reproduction of the MIDI data and audio data controlled by said control means.

34. A musical tone information control method, comprising the steps of:

(a) receiving MIDI data and audio data, in streams, along with time information associated with each of the MIDI data and audio data, wherein the time information was added on a common time axis to each of the MIDI data and audio data to synchronize the MIDI data and audio data;

(b) designating a musical tone parameter;

(c) controlling MIDI data and audio data received in streams in accordance with the musical tone parameter designated by said designating means; and (d) designating a reproduction of the MIDI data and audio data controlled by said control means.

35. A computer readable recording medium storing a program realizing a musical tone information control method, comprising the steps of:

(a) receiving MIDI data and audio data, in streams, along with time information associated with each of the MIDI data and audio data, wherein the time information was added on a common time axis to each of the MIDI data and audio data to synchronize the MIDI data and audio data;

(b) designating a musical tone parameter;

(c) controlling MIDI data and audio data received in streams in accordance with the musical tone parameter designated by said designating means; and (d) designating a reproduction of the MIDI data and audio data controlled by said control means.

* * * * *